US010282939B2

(12) United States Patent
Yamaguchi et al.

(10) Patent No.: US 10,282,939 B2
(45) Date of Patent: May 7, 2019

(54) GAME TABLE APPARATUS

(71) Applicant: Universal Entertainment Corporation, Koto-ku, Tokyo (JP)

(72) Inventors: Shinsuke Yamaguchi, Tokyo (JP); Kouichi Matsumoto, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 179 days.

(21) Appl. No.: 14/973,974

(22) Filed: Dec. 18, 2015

(65) Prior Publication Data

US 2016/0180633 A1 Jun. 23, 2016

(30) Foreign Application Priority Data

Dec. 18, 2014 (JP) ..... 2014-256269

(51) Int. Cl.
*G07F 17/32* (2006.01)

(52) U.S. Cl.
CPC ..... *G07F 17/322* (2013.01); *G07F 17/323* (2013.01); *G07F 17/3211* (2013.01)

(58) Field of Classification Search
None
See application file for complete search history.

(56) References Cited

U.S. PATENT DOCUMENTS 5,809,482 A * 9/1998 Strisower ..... G07F 17/32 705/30
2007/0135193 A1* 6/2007 Nicely ..... A63F 1/00 463/11
2008/0113696 A1* 5/2008 Owen ..... G07F 17/32 463/1
2008/0237987 A1 10/2008 Yoshizawa
2008/0246219 A1* 10/2008 Kyrychenko ..... G07F 17/32 273/292
2009/0191933 A1* 7/2009 French ..... G07F 17/32 463/12
2010/0331085 A1* 12/2010 Nagano ..... G07F 17/3211 463/31
2013/0273989 A1* 10/2013 Tyler ..... G07F 17/32 463/11
2014/0087801 A1* 3/2014 Nicely ..... G07F 17/3293 463/12
2015/0024818 A1* 1/2015 Chun ..... A63F 1/067 463/11

* cited by examiner

*Primary Examiner* — Jason T Yen
(74) *Attorney, Agent, or Firm* — Potomac Law Group, PLLC; Kenneth Fagin

(57) ABSTRACT

Provided is a game table apparatus which allows a player to easily recognize the history of outcomes of games. First display information corresponding to winning or losing of a game is read out from a memory and is displayed on a display; when as a result of conducting a plurality of games, predetermined bias with respect to winning or losing in the plurality of games has occurred and a number of times at which the predetermined bias has occurred is determined to have reached a predetermined threshold value, second display information is read out from the memory; the first display information corresponding to the winning or losing in the plurality of games is changed to the second display information; and the second display information is displayed on the display.

16 Claims, 17 Drawing Sheets

FIG. 12

| NUMBER OF SUCCESSIVE WINS | PRESENTATION MODE |
|---|---|
| 4 OR LESS | NORMAL DISPLAY MODE |
| 5 | FIRST DISPLAY MODE |
| 6 | SECOND DISPLAY MODE |
| 7 | THIRD DISPLAY MODE |
| 8 | FOURTH DISPLAY MODE |
| 9 | FIFTH DISPLAY MODE |

GAME TABLE APPARATUS

CROSS-REFERENCE TO RELATED APPLICATIONS

This application claims the benefit of Japanese Patent Application No. 2014-256269, filed on Dec. 18, 2014, which application is incorporated herein by reference in its entirety.

FIELD OF THE INVENTION

The present invention relates to a game table apparatus for managing a variety of games, which is installed in a game facility such as a casino.

BACKGROUND OF THE INVENTION

In a game facility such as a casino, a variety of games, in each of which cards such as playing cards are used, are played. The cards and chips used in such games are placed on a game table in accordance with the progress of a game. The game table is provided for a game table apparatus. A display for causing a player to view the history of outcomes of the game is also provided for the game table apparatus.

The outcomes of the game displayed on the display provided for this conventional game table apparatus are displayed by using a variety of marks, symbols, and the like in addition to character information in order to allow easy viewing (for example, refer to U. S. Patent Application Publication No. 2010/331085 and U. S. Patent Application Publication No. 2008/237987).

In the game facility, a plurality of game tables are installed, and a variety of games are played on these respective game tables in parallel with one another. In the game facility, players are walking about while looking for a game table which arouses the interest of each of the players, for example, a game table from which each of the players is likely to obtain a profit as large as possible. Upon looking for a game table, each of the players determines the game table based on a kind of a game, outcomes of the game, and the like.

Therefore, the outcomes of the game are important information to select a game table. Accordingly, the outcomes of the game are information in which a player is interested, it is required to accurately convey the information to a player, and it is important to precisely display the information.

In addition, depending on the progress of a game, there may be a case where successive winning or losing occurs. When the successive winning has occurred, it can be determined that even after this, the winning will continue and also that next, losing will occur. This is the same as when the successive losing occurs. Therefore, a state in which the successive winning or the successive losing is continuing, that is, the history of the outcomes of the game, is a state in which a player gets more interested, and the history is one of the pieces of information which a player wants to know.

As described above, while walking about in the game facility, each of the players is looking for a game table from which each of the players is likely to expect a profit as large as possible. However, if a period of time during which each of the players is looking for a game table is long, a period of time during which each of the players is not playing a game is increased, thereby making it impossible to increase a profit of the game facility. It is preferable for the game facility that each of the players determines a game table for a short period of time and plays a game for a period of time as long as possible. Accordingly, not only it is required to accurately display the outcomes of the game to each of the players, but also it is required to allow the history of the outcomes of the game be determined for a short period of time even at a distance away from a game table.

In view of the above-described points, the present invention was made, and an object of the present invention is to provide a game table apparatus which allows a player to easily recognize the history of outcomes of a game.

BRIEF SUMMARY OF THE INVENTION

A first aspect of the present invention is a game table apparatus which includes:

a controller for managing winning or losing of a game;

a memory for storing first display information and second display information whose display mode is different from a display mode of the first display information; and a display for displaying the first and second display information to a player in a visually recognizable manner, and the controller is configured to execute processes described below:

a process (1-1) in which the first display information corresponding to the winning or losing of the game is read out from the memory and is displayed on the display; and a process (1-2) in which when as a result of conducting a plurality of games, predetermined bias with respect to winning or losing in the plurality of games has occurred and a number of times at which the predetermined bias has occurred is determined to have reached a predetermined threshold value, the second display information is read out from the memory, the first display information corresponding to the winning or losing in the plurality of games is changed to the second display information, and the second display information is displayed on the display.

When the predetermined bias with respect to the winning or losing in the plurality of games has occurred, the first display information is changed to the second display information whose display mode is different from that of the first display information, thus allowing a player to easily visually recognize that the predetermined bias with respect to the winning or losing in the plurality of games has occurred.

A second aspect of the present invention is configured such that the first display information is information displayed in a still display mode, the second display information is information displayed in a moving display mode, the process (1-1) is a process in which pieces of the first display information are sequentially displayed on the display so as to neighbor to one another, each of the pieces of the first display information being displayed each time a game is finished, and the process (1-2) is a process (2-1) in which when the predetermined bias with respect to the winning or losing in a plurality of successive games has occurred, the first display information corresponding to the winning or losing in the plurality of successive games is changed to the second display information, and the second display information is displayed on the display.

When the predetermined bias with respect to the winning or losing in the plurality of successive games has occurred, the displaying is conducted by switching the display mode from the still display mode (first display information) to the moving display mode (second display information). Further, the plurality of pieces of the second display information are displayed so as to neighbor to one another, that is, are successively displayed. Therefore, since one group of the plurality of pieces of the second display information is displayed in the moving display mode, it is made possible for the one group to be conspicuous and to be clearly visually recognizable even from a remote location.

A third aspect of the present invention is the game table apparatus which further includes a card shoe for holding cards to conduct a game on a game table and for allowing the cards to be taken out, the card shoe has a detection device for detecting and outputting pieces of identification information of the cards taken out from the card shoe, and the controller is configured to further execute:

a process (3-1) in which the pieces of the identification information of the cards outputted from the detection device are accumulated in the memory; and a process (3-2) in which based on the pieces of the identification information of the cards accumulated in the memory, the winning or losing in the game is determined.

Based on the pieces of identification information of the cards outputted from the detection device, the winning or losing in the game is determined. A human such as a dealer does not determine the winning or losing in the game, and the controller determines the winning or losing in the game, thus allowing human errors and fraudulent act to be prevented and enabling fair proceeding of the game.

A fourth aspect of the present invention is configured such that the process (1-2) is a process (4-1) in which when a number of games in which the predetermined bias has successively occurred is a predetermined number or more, the first display information is changed to the second display information, and the second display information is displayed on the display.

Even when the bias has successively occurred, if the number of games in which the bias has successively occurred is small (less than the predetermined number), it is a commonplace state for a player, and it is not required to change the presentation. On the other hand, if the number of games in which the bias has successively occurred is large (the predetermined number or more), since it is a special state, the first display information is changed to the second display information and the second display information is displayed thereon, thereby allowing a sense of expectation to be enhanced.

A fifth aspect of the present invention is the game table apparatus in which the controller is configured to further executes a process (5-1) in which when in a game conducted after the predetermined bias has occurred, the predetermined bias is finished, the second display information is returned to the first display information, and the first display information is displayed on the display.

When the bias with respect to the winning or losing in the game is finished, the second display information is returned to the first display information, thereby allowing a player to clearly visually recognize that the bias with respect to the winning or losing in the game has already been finished. Even when the bias has been finished, the latest game state is displayed, thereby allowing erroneous recognition with respect to the winning or losing in the game to be prevented.

A sixth aspect of the present invention is the game table apparatus which further includes an input device for allowing a user to perform an input operation, and when identification information of a card outputted from the detection device is invalid, the input device allows valid identification information of the card taken out from the card shoe to be inputted, and winning or losing in a game is determined in accordance with the valid identification information.

When the identification information of the card outputted from the detection device is invalid, an outcome of the game is determined by correcting the invalid identification information to the valid identification information, thereby allowing the determination of the outcome of the game by the invalid identification information of the card to be prevented. Thus, profits on both sides of a game facility and a player can be protected, and while fairness of games is maintained, appropriate information regarding the winning or losing in a game and the bias with respect to the winning or losing in a game can be provided.

A seventh aspect of the present invention is configured such that the second display information has a plurality of pieces of presentation-related information which are defined each in accordance with a number of games and whose display modes are different from one another, and the process (2-1) is a process (7-1) in which when the plurality of games are conducted and the number of games in which the predetermined bias has successively occurred is sequentially increased, the presentation-related information corresponding to the number of games is read out from the memory and is displayed on the display.

Since the pieces of presentation-related information corresponding to the number of games are displayed as the second display information, the second display information can be displayed in the display mode which corresponds to the number of games in which the bias has occurred and is different from the other display modes, thereby allowing a player to clearly visually recognize that the state in which the bias has occurred is gradually increasing.

It is made possible to cause a player to easily recognize the history of the outcomes of the game.

These and other aspects, features and advantages of the present invention will become readily apparent to those having ordinary skill in the art upon a reading of the following detailed description of the invention in view of the drawings and claims.

BRIEF DESCRIPTION OF THE DRAWINGS

The nature and mode of operation of the present invention will now be more fully described in the following detailed description of the invention taken with the accompanying drawing figures, in which:

FIG. 12 is a table showing a relationship between numbers of wins and image data of a first to fifth display modes;

DETAILED DESCRIPTION OF THE PREFERRED EMBODIMENT

<<<Outline of Game Table Apparatus of the Present Embodiment>>>

Figure 1A:
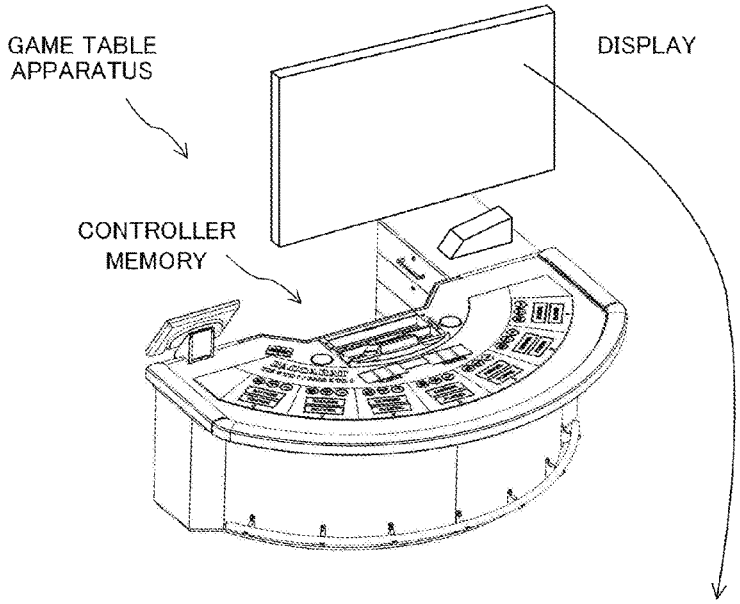
FIGS. 1A to 1C are diagrams illustrating an outline of a game table apparatus according to the present embodiment.
Figure 1B:
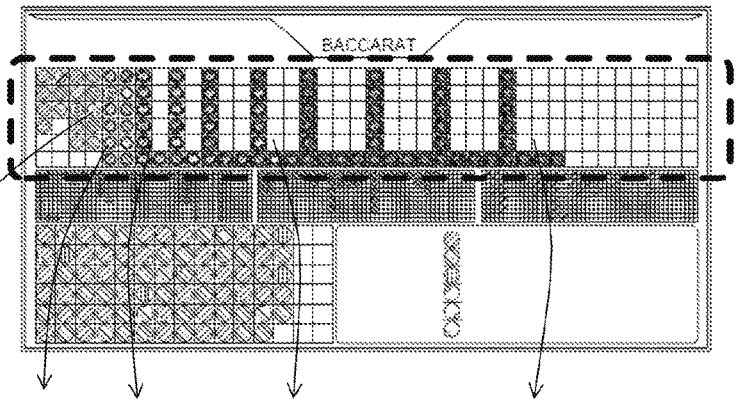
Figure 1C:
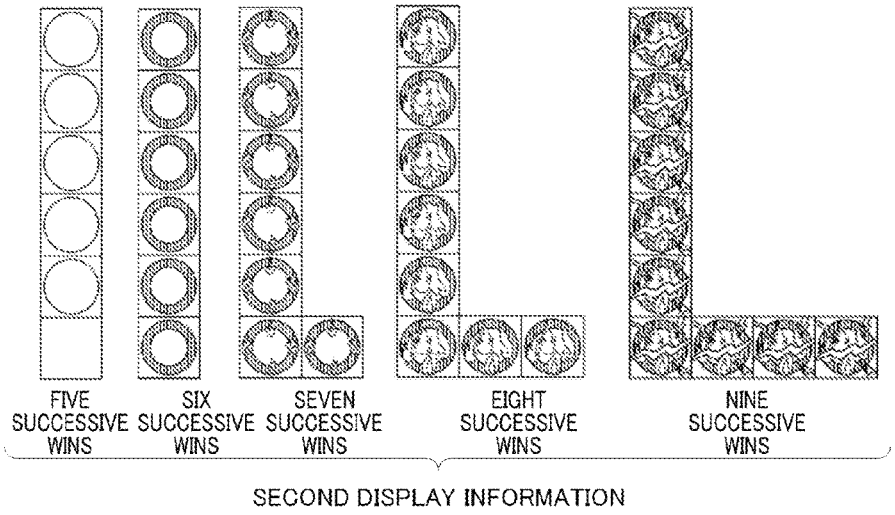

Hereinafter, an embodiment will be described with reference to the accompanying drawings. FIGS. 1A to 1C are diagrams illustrating an outline of a game table apparatus according to the present embodiment.

Figure 9:
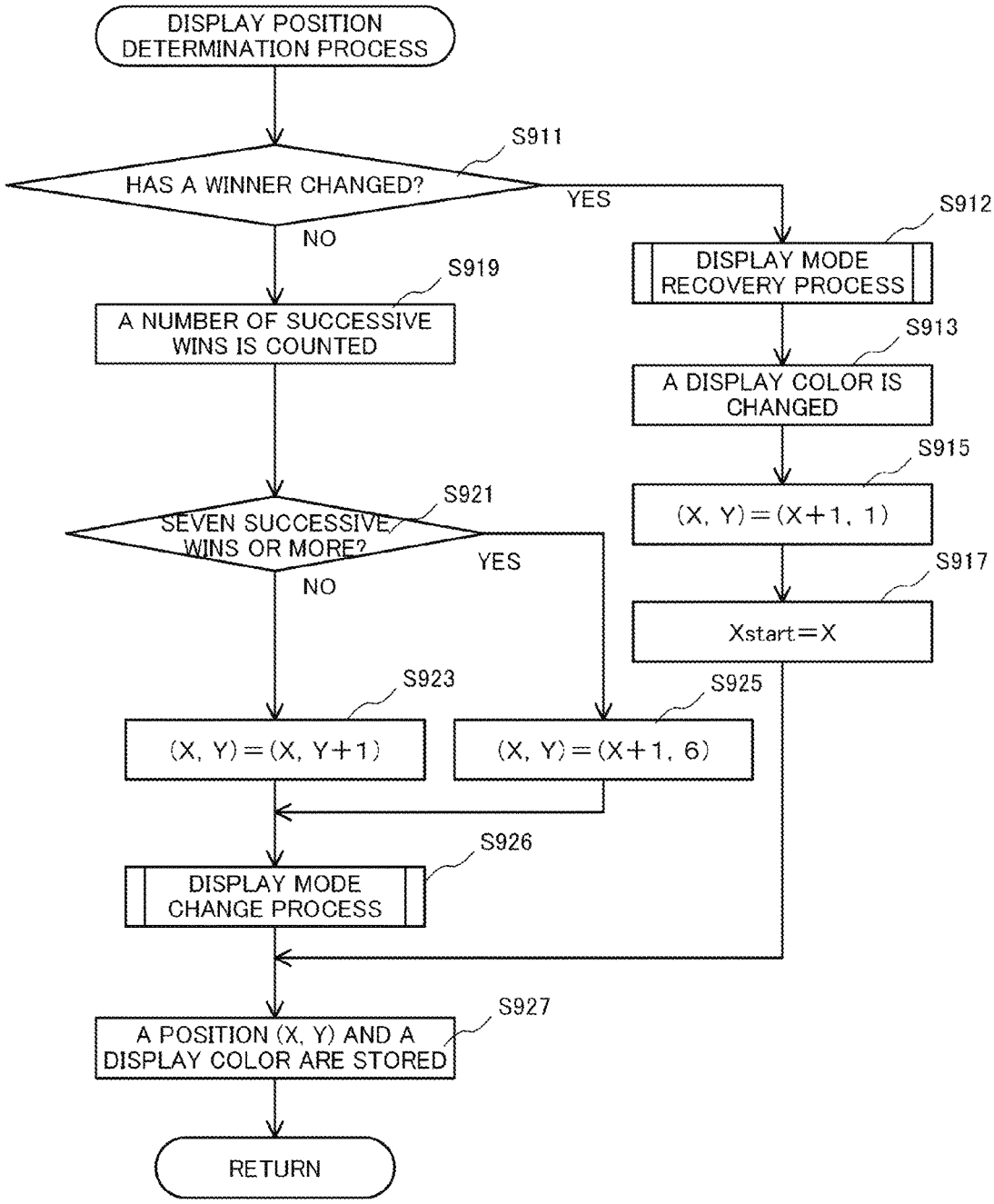
FIG. 9 is a flowchart showing an example of a display position determination process.
Figure 10:
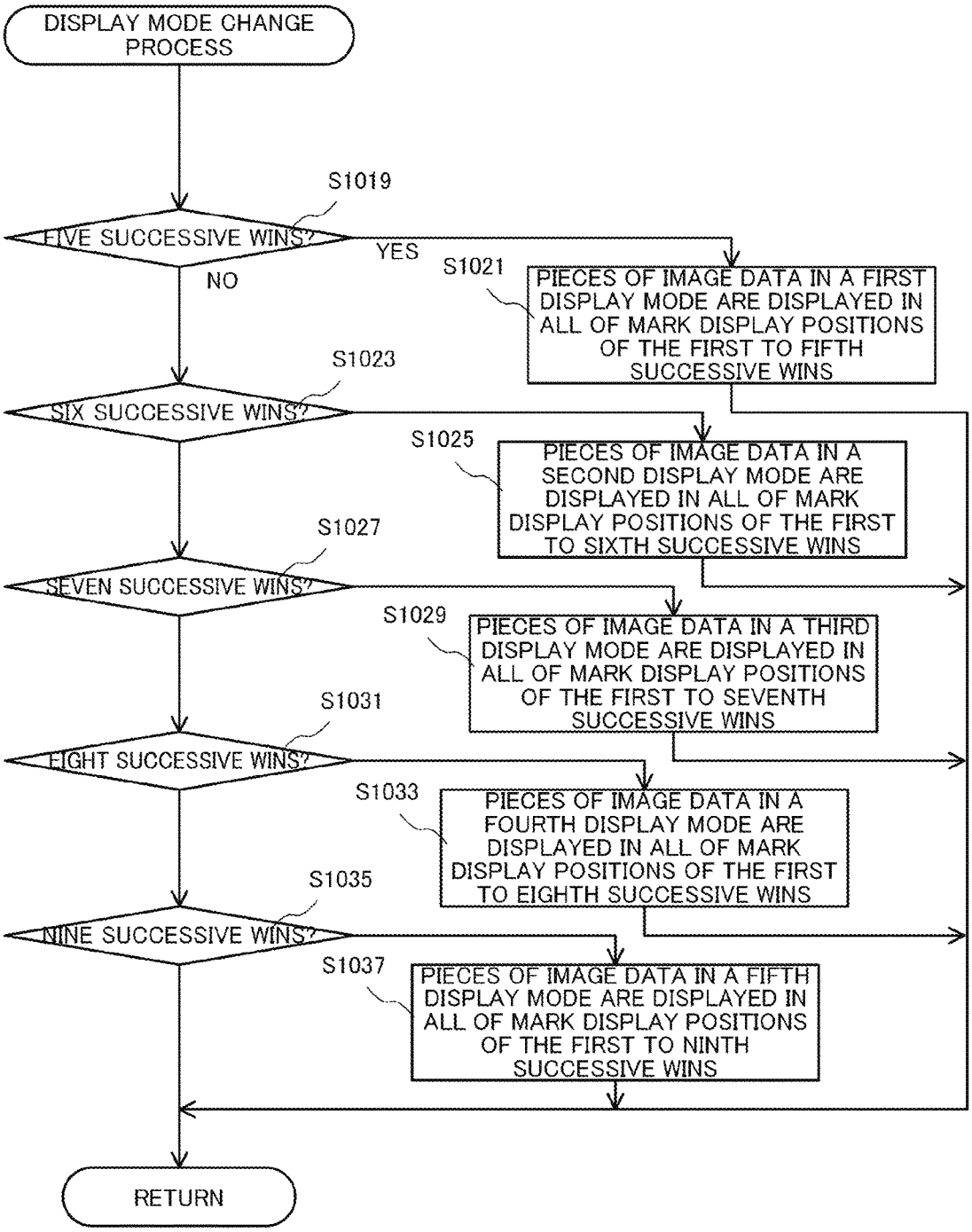
FIG. 10 is a flowchart showing an example of a display mode change process.

The game table apparatus according to the present embodiment is a game table apparatus (for example, the later-described game table apparatus 100 or the like) which includes:

a controller for managing winning or losing of a game (for example, the later-described first control unit 200 or the like);

a memory for storing first display information (for example, the later-described normal display mode or the like) and second display information whose display mode is different from a display mode of the first display information (for example, the later-described first display mode to fifth display mode, or the like) (for example, the later-described RAM 216, HDD 218, or the like); and a display for displaying the first and second display information to a player in a visually recognizable manner (for example, the later-described game outcome notification display 300 or the like), and the controller executes processes described below:

a process (1-1) in which the first display information corresponding to the winning or losing of the game is read out from the memory and is displayed on the display (for example, the later-described step S912 in FIG. 9, steps S1015 and S1017 in FIG. 11, or the like); and a process (1-2) in which when as a result of conducting a plurality of games, predetermined bias with respect to winning or losing in the plurality of games has occurred and a number of times at which the predetermined bias has occurred is determined to have reached a predetermined threshold value, the second display information is read out from the memory, the first display information corresponding to the winning or losing in the plurality of games is changed to the second display information, and the second display information is displayed on the display (for example, the later-described step S927 in FIG. 9 and steps S1019 to S1037 in FIG. 10, or the like).

As shown in FIG. 1A, the game table apparatus includes: the controller, the memory, and the display.

The memory stores the first display information and the second display information. The display mode of the second display information is different from that of the first display information. As shown in FIG. 1B, the display displays the display information to a player in the visually recognizable manner.

The controller manages the winning or losing in the game and executes the variety of processes. The controller reads out the first display information corresponding to the winning or losing in the game from the memory and displays the first display information on the display.

There may be a case where the plurality of games are conducted and as the result thereof, the predetermined bias with respect to the winning or losing in the plurality of games occurs. As the bias with respect to the winning or losing, for example, there are a tendency in which the winning easily occurs, a tendency in which the losing easily occurs, and the like. In addition, when the winning or losing occurs in a varied manner, no bias occurs.

Further, the controller determines whether or not the number of times at which the predetermined bias has occurred has reached the predetermined threshold value. For example, the threshold value indicates a number of times such as five times, six times, and seven times. As described above, the threshold value is not limited to one value, and the plurality of threshold values can be arranged. It is only required to determine whether or not the number of times at which the predetermined bias has occurred has matched any of the number of times.

When the number of times at which the predetermined bias has occurred has reached the predetermined threshold value, the second display information is read out from the memory, the first display information corresponding to the winning or losing in the plurality of games is changed to the second display information (FIG. 1C), and the second display information is displayed on the display. In other words, redisplaying is conducted by changing the first display information to the second display information.

When the predetermined bias with respect to the winning or losing in the plurality of games has occurred, the first display information is changed to the second display information whose display mode is different from that of the first display information, thus allowing a player to easily visually recognize via the display that the predetermined bias with respect to the winning or losing in the plurality of games has occurred.

Further, in the game table apparatus according to the present embodiment, the first display information is information displayed in a still display mode (for example, the later-described normal display mode FIG. 12 or the like), the second display information is information displayed in a moving display mode (for example, the later-described first display mode to fifth display mode in FIG. 12 or the like), the process (1-1) is a process in which pieces of the first display information are sequentially displayed on the display so as to neighbor to one another, each of the pieces of the first display information being displayed each time a game is finished (for example, the later-described steps S923 and S925 in FIG. 9, or the like), and the process (1-2) is a process (2-1) in which when the predetermined bias with respect to the winning or losing in a plurality of successive games has occurred, the first display information corresponding to the winning or losing in the plurality of successive games is changed to the second display information, and the second display information is displayed on the display (for example, the later-described step S927 in FIG. 9, steps S1019 to S1037 in FIG. 10, or the like).

When the predetermined bias with respect to the winning or losing in the plurality of successive games has occurred, the displaying is conducted by switching the display mode from the still display mode (first display information) to the moving display mode (second display information). Further, the pieces of the second display information are displayed so as to neighbor to one another, that is, are successively displayed. Therefore, since one group of the plurality of pieces of the second display information (one block, one cluster, or the like thereof) is displayed in the moving display mode, it is made possible for the one group to be conspicuous and to be clearly visually recognizable even from a remote location.

Further, the game table apparatus according to the present embodiment further includes:

a card shoe for holding cards to conduct a game on a game table and for allowing the cards to be taken out (for example, the later-described card shoe 310 or the like), the card shoe has a detection device for detecting and outputting pieces of identification information of the cards taken out from the card shoe (for example, the later-described detection unit 320 or the like), and the controller is configured to further execute:

a process (3-1) in which the pieces of the identification information of the cards outputted from the detection device are accumulated in the memory (for example, the later-described step S813 in FIG. 8 or the like); and a process (3-2) in which based on the pieces of the identification information of the cards accumulated in the memory, the winning or losing in the game is determined (for example, the later-described step S815 in FIG. 8 or the like).

Based on the pieces of identification information of the cards detected by the detection device, the winning or losing in the game is determined. A human such as a dealer does not determine the winning or losing in the game, and the controller determines the winning or losing in the game, thus allowing human errors and fraudulent act to be prevented and enabling fair proceeding of the game.

The detection device may be a device which optically detects the identification information thereof by using infrared light or the like, a device which electromagnetically detects the identification information thereof by using an RFID tag or the like, or a device which detects the identification information thereof with images by using a camera or the like. Upon using any of the above-mentioned detection devices, it is only required for the detection device to be capable of obtaining the identification information of the card as data with which the controller can make the determination.

The winning or losing in the game can be determined by the pieces of identification information of the cards outputted from the detection device, it is quickly determined whether or not the predetermined bias with respect to the winning or losing in the game has occurred, and the second display information can be thereby displayed.

Furthermore, in the game table apparatus according to the present embodiment, the process (1-2) is a process (4-1) in which when a number of games in which the predetermined bias has successively occurred is a predetermined number or more, the first display information is changed to the second display information, and the second display information is displayed on the display (for example, the later-described step S927 in FIG. 9, steps S1019 to S1037 in FIG. 10, or the like).

Even when the bias has successively occurred, if the number of games in which the bias has successively occurred is small (less than the predetermined number), it is a commonplace state for a player, and it is not required to change the presentation. On the other hand, if the number of games in which the bias has successively occurred is large (the predetermined number or more), since it is a special state, the first display information is changed to the second display information and the second display information is displayed thereon, thereby allowing a sense of expectation to be enhanced.

For example, pieces of the second display information whose number corresponds to a number of games in which the bias has successively occurred are displayed, thereby allowing a player to further clearly visually recognize that the predetermined bias has successively occurred. Specifically, the pieces of the second display information whose number corresponds to a number of games in which the bias has successively occurred can be displayed in a successively grouped manner.

In addition, in the game table apparatus according to the present embodiment, the controller further executes a process (5-1) in which when in a game conducted after the predetermined bias has occurred, the predetermined bias is finished, the second display information is returned to the first display information, and the first display information is displayed on the display (for example, the later-described step S912 in FIG. 9, steps S1013 to S1017 in FIG. 11, or the like).

When the bias with respect to the winning or losing in the game is finished, the second display information is returned to the first display information, thereby allowing a player to clearly visually recognize that the bias with respect to the winning or losing in the game has already been finished. Even when the bias has been finished, the latest game state is displayed, thereby allowing erroneous recognition with respect to the winning or losing in the game to be prevented.

In addition, the game table apparatus according to the present embodiment further includes an input device for allowing a user to perform an input operation (for example, the later-described keyboard 222, or the like), and when identification information of a card outputted from the detection device is invalid, the input device allows valid identification information of the card taken out from the card shoe to be inputted therefrom, and winning or losing in a game is determined in accordance with the valid identification information.

When the identification information of the card outputted from the detection device is invalid, an outcome of the game is determined by correcting the invalid identification information to the valid identification information, thereby allowing the determination of the outcome of the game by the invalid identification information of the card to be prevented. Thus, profits on both sides of a game facility and a player can be protected, and while fairness of games is maintained, appropriate information regarding the winning or losing in a game and the bias with respect to the winning or losing in a game can be provided.

Figure 11:
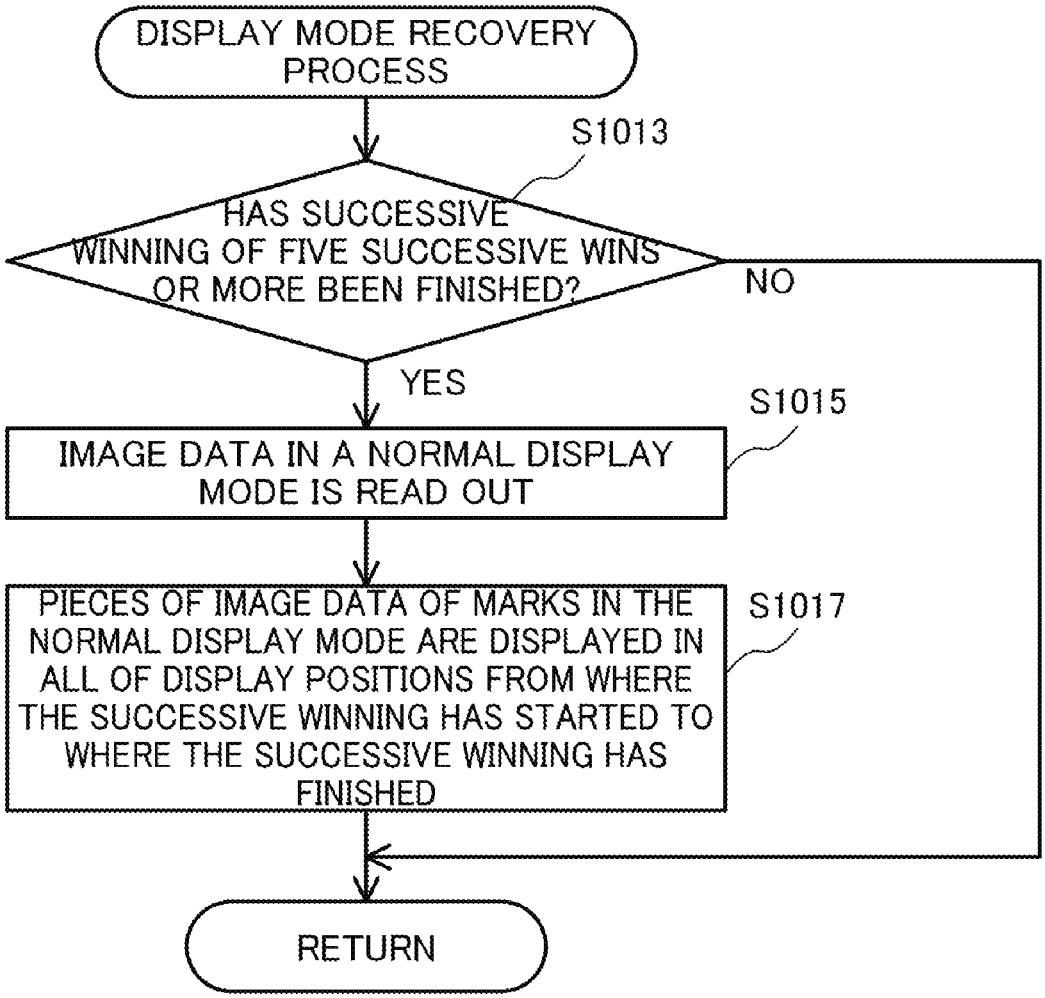
FIG. 11 is a flowchart showing an example of a display mode recovery process.

Furthermore, in the game table apparatus according to the present embodiment, the second display information has a plurality of pieces of presentation-related information which are defined each in accordance with a number of games and whose display modes are different from one another, and the process (2-1) is a process (7-1) in which when the plurality of games are conducted and the number of games in which the predetermined bias has successively occurred is sequentially increased, the presentation-related information corresponding to the number of games is read out from the memory and is displayed on the display (for example, the later-described step S912 in FIG. 9, steps S1013 to S1017 in FIG. 11, and FIG. 12, or the like).

Since the pieces of presentation-related information corresponding to the number of games are displayed as the second display information, the second display information can be displayed in the display mode which corresponds to the number of games in which the bias has occurred and is different from the other display modes, thereby allowing a player to clearly visually recognize that the state in which the bias has occurred is gradually increasing.

Furthermore, a game table apparatus according to the present embodiment is a game table apparatus (for example, the later-described game table apparatus 100 or the like) which includes:

a card shoe for holding cards to conduct a game on a game table and for allowing the cards to be taken out (for example, the later-described card shoe 310, or the like);

a controller for managing winning or losing of a game (for example, the later-described first control unit 200 or the like);

a memory for storing first display information and second display information whose display mode is different from a display mode of the first display information (for example, the later-described RAM 216, HDD 218, or the like); and a display for displaying the first and second display information to a player in a visually recognizable manner (for example, the later-described game outcome notification display 300 or the like), the card shoe has a detection device for reading out and outputting pieces of identification information of the cards taken out (for example, the later-described detection unit 320, or the like), an outcome of a game (for example, the later-described winner or the like) is allowed to be determined based on the pieces of identification information of the cards (for example, the later-described suit information and numerical information, or the like), the first display information is information selected in accordance with winning or losing in the game (for example, the later-described normal display mode in FIG. 12 or the like), the second display information is information selected in accordance with bias with respect to the winning or losing in the game (for example, the later-described first display mode to fifth display mode in FIG. 12 or the like), and the controller is programmed to execute processes described below:

a process (X-1-1) in which when the cards are taken out from the card shoe, the pieces of identification information of the cards outputted from the detection device are accumulated in the memory (for example, the later-described step S813 in FIG. 8 or the like);

a process (X-1-2) in which determined is whether or not based on the pieces of identification information of the cards accumulated in the memory, determining winning or losing in a game is enabled (for example, the later-described step S815 in FIG. 8 or the like);

a process (X-1-3) in which when determining the winning or losing in the game is not enabled, the process (X-1-1) and the process (X-1-2) are repeated until determining the winning or losing in the game comes to be enabled (for example, the later-described step S815 in FIG. 8 or the like);

a process (X-1-4) in which when determining the winning or losing in the game is enabled, the first display information corresponding to the winning or losing in the game is read out from the memory (for example, the later-described step S1015 in FIG. 11 or the like);

a process (X-1-5) in which the first display information is displayed on the display (for example, the later-described step S1017 in FIG. 11 or the like);

a process (X-1-6) in which by repeatedly executing the process (X-1-1) to the process (X-1-5), determined is whether or not winning has successively occurred by conducting a plurality of games (for example, the later-described step S911 FIG. 9 or the like);

a process (X-1-7) in which when the winning has successively occurred, a number of games in which the winning has successively occurred is counted (for example, the later-described step S919 in FIG. 9 or the like);

a process (X-1-8) in which based on the number of games counted in the process (X-1-7), any of pieces of the second display information is selected and read out from the memory (for example, the later-described steps S1019 to S1037 in FIG. 10 or the like); and a process (X-1-9) in which instead of the first display information, the read-out piece of the second display information is displayed on the display (for example, the later-described steps S1019 to S1037 in FIG. 10 or the like).

Furthermore, in the game table apparatus according to the present embodiment, the second display information has a plurality of pieces of display information, each of which is defined in accordance of each number of a plurality of games (for example, the later-described first display mode to fifth display mode in FIG. 12 or the like), display modes of the plurality of pieces of display information are different from one another, and the process (X-1-8) is a process (X-2-1) in which any of the plurality of pieces of display information which corresponds to the number of games counted in the process (X-1-7) is selected and read out from the memory (for example, the later-described steps S1019 to S1037 in FIG. 10 or the like).

Furthermore, in the game table apparatus according to the present embodiment, the game is a game in which a virtual banker and a virtual player have a match, the process (X-1-9) is a process (X-3-1) in which when winning of one of the virtual banker and the virtual player has successively occurred over a predetermined number of a plurality of games, instead of the first display information, the second display information is displayed on the display.

Furthermore, the game table apparatus according to the present embodiment further includes:

a detection device for detecting a chip for betting placed on the game table (for example, the later-described antenna module 430 or the like); and a management device for determining authenticity of the chip for betting based on a detection result detected by the detection device (for example, the later-described second control unit 400 or the like).

<<<Game Table Apparatus System 10>>>

Figure 2:
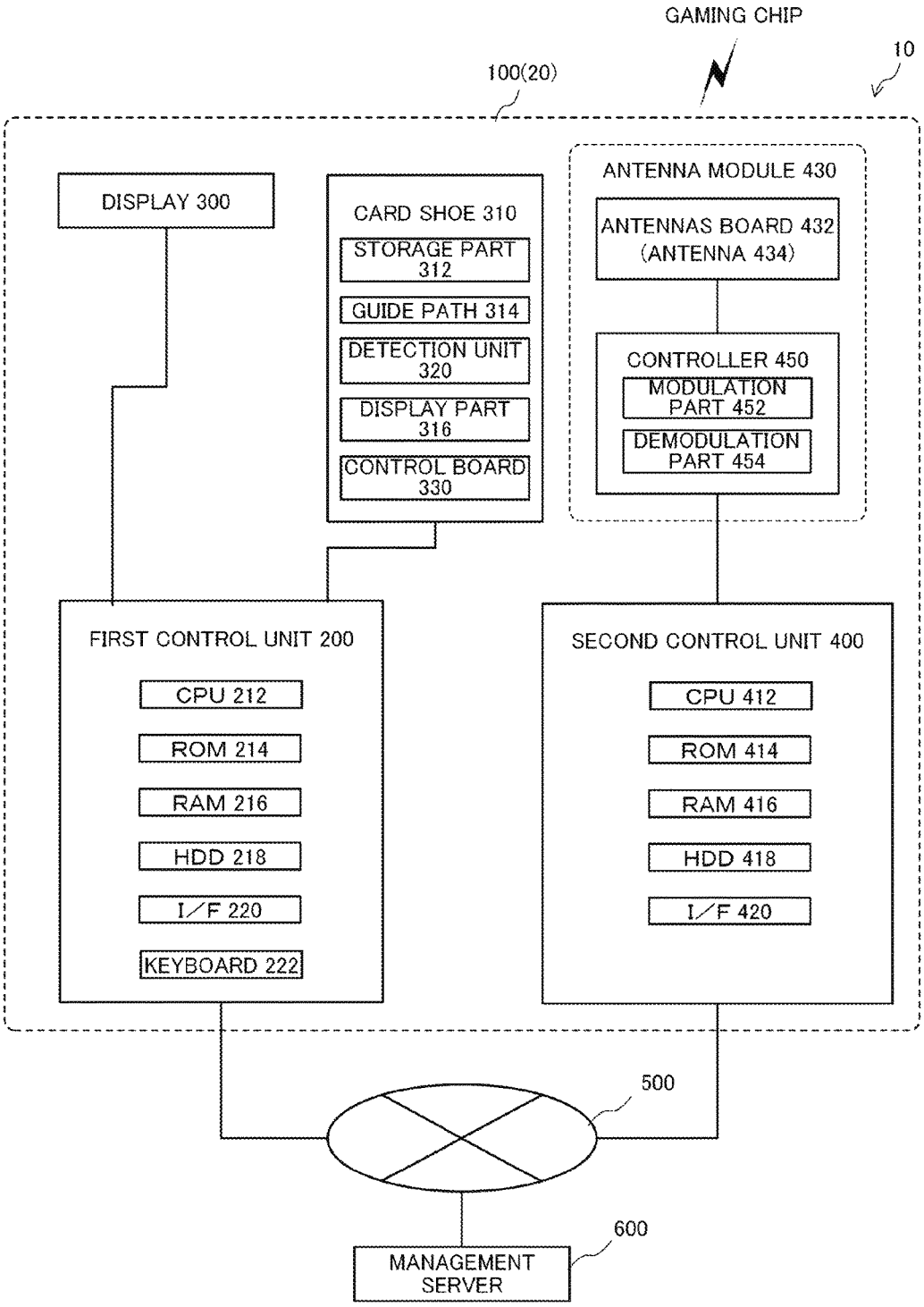
FIG. 2 is a functional block diagram illustrating an outline of a game table apparatus system 10.

FIG. 2 is a functional block diagram illustrating an outline of a game table apparatus system 10. The game table apparatus system 10 is installed in a game facility such as a casino.

Figure 3:
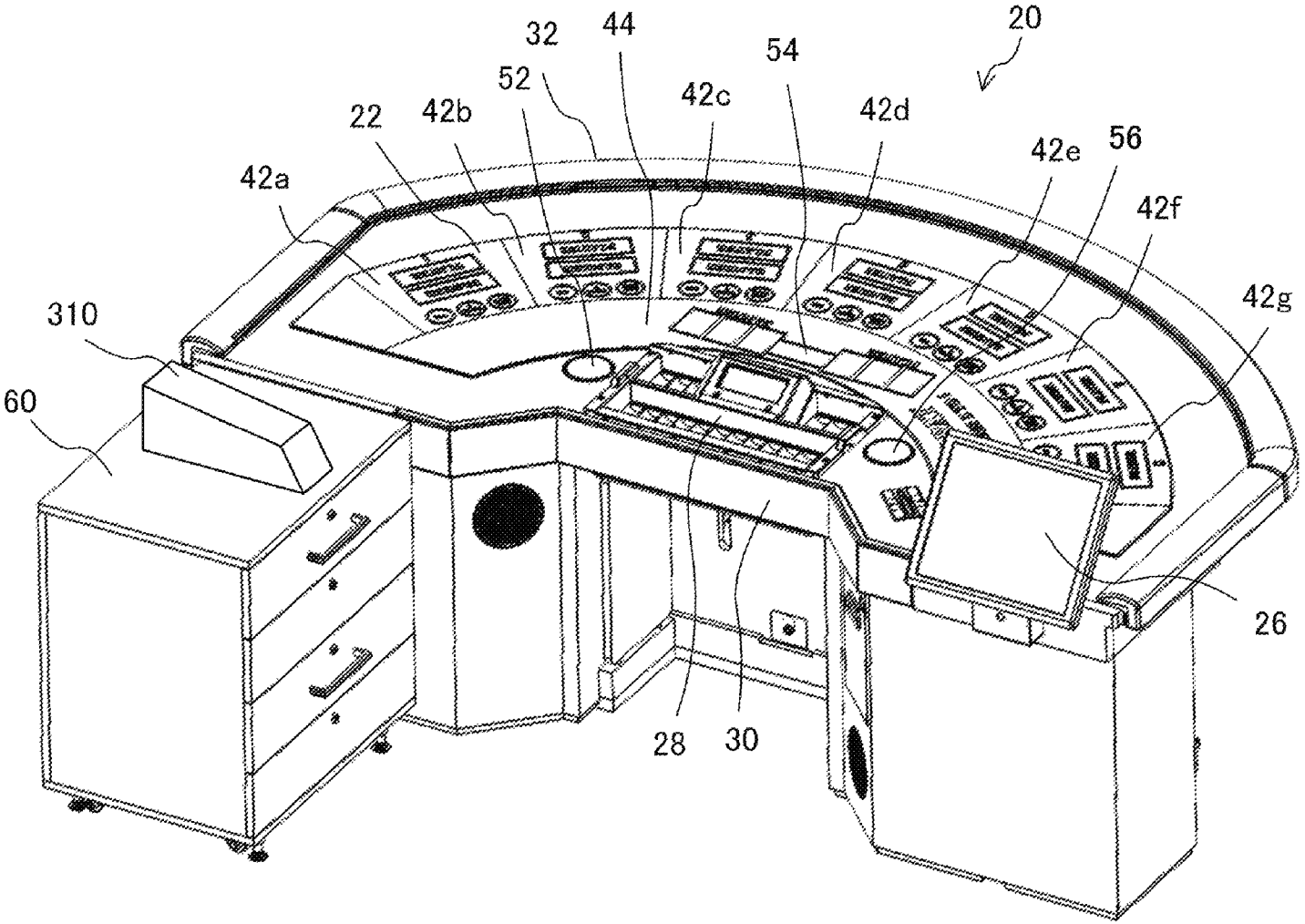
FIG. 3 is a perspective view taken when a game table 20 according to the present embodiment is viewed from a dealer side.
Figure 4:
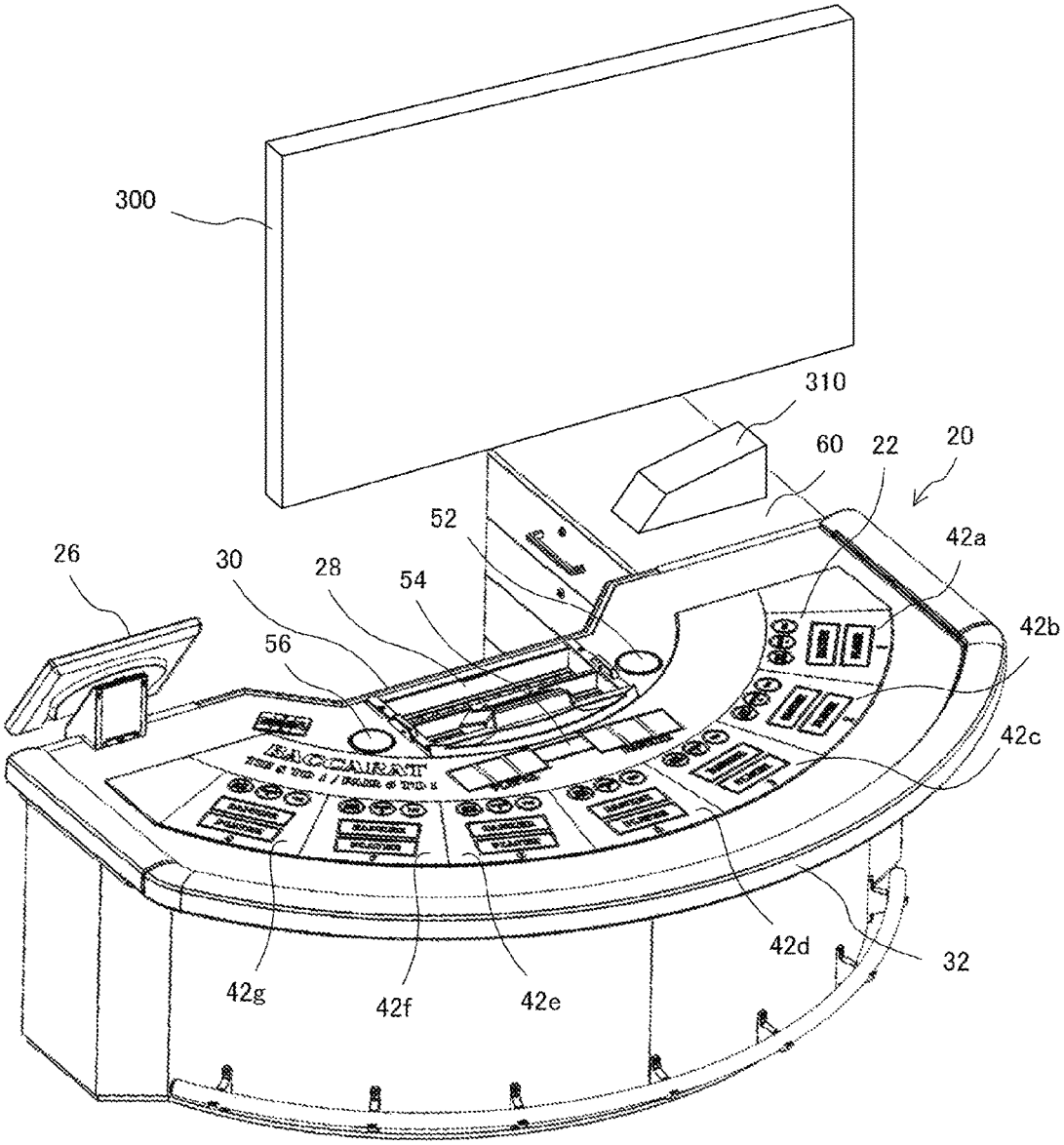
FIG. 4 is a perspective view taken when the game table 20 according to the present embodiment is viewed from a player side.

The game table apparatus system 10 includes: a game table apparatus 100; a network 500; and a management server 600. As shown in FIG. 3 and FIG. 4, the game table apparatus 100 has a game table 20 (the so-called casino table).

<Game Table Apparatus 100>

The game table apparatus 100 includes: a first control unit 200; a game outcome notification display 300; a card shoe 310; a second control unit 400; and an antenna module 430.

<First Control Unit 200>

The first control unit 200 is constituted of a computer, includes mainly: a CPU (central processing unit) 212; a ROM (read-only memory) 214; a RAM (random access memory) 216; an HDD (hard disk drive) 218; a communication I/F (communication interface) 220; a keyboard 222; and the like, and is communicatively connected by a data bus and an address bus (not shown).

<Game Outcome Notification Display 300>

Connected to the first control unit 200 is the game outcome notification display 300. By the control of the first control unit 200, on the game outcome notification display 300, information pertinent to an outcome of a game conducted on the game table 20 (refer to FIG. 3 and FIG. 4), for example, winning or losing and information pertinent to the winning or losing are displayed. A player can visually recognize a variety of pieces of information displayed on the game outcome notification display 300. The details of the information displayed on the game outcome notification display 300 will be described later.

<Card Shoe 310>

Connected to the first control unit 200 is the card shoe 310. The card shoe 310 is operated by a dealer. The card shoe 310 holds a plurality of cards for a game such as playing cards. The dealer takes out the cards for a game from the card shoe 310 and places the cards on the game table 20.

Identification information of the cards for a game taken out from the card shoe 310 is transmitted to the first control unit 200. The first control unit 200 determines the progress and an outcome of a game from the identification information of the cards for a game transmitted from the card shoe 310. The details of the card shoe 310 will be described later.

<Second Control Unit 400>

The second control unit 400 is constituted of a computer, includes mainly: a CPU (central processing unit) 412; a ROM (read-only memory) 414; a RAM (random access memory) 416; an HDD (hard disk drive) 418; and a communication I/F (communication interface) 420, and is communicatively connected by a data bus and an address bus (not shown).

<Antenna Module 430>

Communicatively connected to the second control unit 400 is the antenna module 430. The antenna module 430 reads out identification information of a gaming chip and transmits the identification information to the second control unit 400. The details of the antenna module 430 will be described later.

<Network 500>

The network 500 communicatively connects the first control unit 200 and the second control unit 400 with the management server 600. The network 500 may be a network formed inside of a game facility or a network formed outside of a game facility.

<Management Server 600>

The management server 600 mainly manages information pertinent to a game such as gaming chips and a player. The gaming chips are media each having a monetary value in a game facility. All of the gaming chips used in a game facility are managed by the management server 600. Pieces of chip identification information which are different from one another are assigned to all of the gaming chips. States of the gaming chips are managed based on the chip identification information. As the states of the gaming chips, there are a state in which the gaming chips are held by a player, a state in which the gaming chips are kept by a game facility, and the like. The management server 600 stores and manages these pieces of information as a database. Each time any of the states of the gaming chips is changed, the database is updated.

The management server 600 may be installed within a game facility or outside of a game facility. It is only required for the management server 600 to be communicatively connected by the network 500 and to be capable of managing the information pertinent to a game.

<<Game Table 20>>

FIG. 3 is a perspective view taken when the game table 20 according to the present embodiment is viewed from a dealer side. FIG. 4 is a perspective view taken when the game table 20 according to the present embodiment is viewed from a player side.

<<Game Gable 20>>

The game table 20 mainly has: a game board 22; the game outcome notification display 300 (FIG. 4); the card shoe 310; a dealer display 26; and a chip tray 28.

The game table 20 has a dealer part 30 and a player part 32. The dealer part 30 is an inside of the game table 20 and a dealer is situated there. The player part 32 is an outside of the game table 20 and a plurality of players, for example, seven players are situated there. The dealer and the players face each other with the game table 20 sandwiched therebetween, and a variety of games such as baccarat, poker, and blackjack are played on the game table 20. On the game table 20, in accordance with the progress of a game, gaming cards such as playing cards and gaming chips are placed and collected.

<<Game Board 22>>

The game board 22 has a substantially fan-like shape. On the game board 22, game areas 42*a* to 42*g* for seven players are formed. Each of the game areas 42*a* to 42*g* is an area which each of the players uses. Hereinafter, in a case where there is no need to distinguish the game areas 42*a* to 42*g*, the game areas 42*a* to 42*g* are referred to as game areas 42.

Each of the game areas 42 has a plurality of bet regions. Each of the game areas 42 is formed by, for example, a sheet having the bet regions printed thereon (not shown). A size, a shape, and a number of each of the bet regions of the game areas 42 are defined in accordance with a kind of a game such as the baccarat and the blackjack.

On the game board 22, a dealer area 44 is also formed. The dealer area 44 is an area which a dealer uses.

On a back side of the game board 22 (not shown), seven antenna modules 430 (refer to FIG. 2) are provided so as to correspond to the respective game areas 42*a* to 42*g*. Similarly, also in the dealer area 44, one antenna module 430 is provided.

In each of the antenna modules 430, a plurality of antenna 434 are provided so as to correspond to the bet regions of each of the game areas 42. A gaming chip has an IC tag for RFID built therein. The IC tag for RFID has chip information stored therein. The chip information is constituted of a variety of pieces of information such as chip identification information for identifying a gaming chip. When a gaming chip is placed on each of the bet regions, the chip information stored in the IC tag for RFID can be read out by the antenna 434.

The antenna module 430 is communicatively connected to a controller 450 and a second control unit 400 which are mounted in the game table 20. The chip information read out by the antenna 434 is transmitted via the controller 450 to the second control unit 400. A configuration and an operation of the antenna module 430 will be described later.

<<Erasing Antenna Device 52, Reference Antenna Device 54, and Registration Antenna Device 56>>

The dealer part 30 is provided with three kinds of antenna devices which are an erasing antenna device 52, a reference antenna device 54, and a registration antenna device 56. The erasing antenna device 52 is provided on a left side of the chip tray 28, the reference antenna device 54 is provided on a rear side of the chip tray 28 (player part 32), and the registration antenna device 56 is provided on a right side of the chip tray 28. In front of the chip tray 28, a dealer is situated.

The erasing antenna device 52 is an antennas for erasing information pertinent to a player, for example, player identification information for identifying a player. The registration antenna device 56 is an antennas for registering the player identification information. Besides the management server 600, connected to the second control unit 400 are the erasing antenna device 52, the reference antenna device 54, the registration antenna device 56, and the like.

The erasing and the registration of the player identification information are performed via the second control unit 400 of the game table 20 by the management server 600 in a game facility. The management server 600 associates the chip identification information with the player identification information and stores the chip identification information associated with the player identification information in the database. Based on a variety of pieces of information transmitted from the second control unit 400, the management server 600 updates a correspondence relation between the chip identification information and the player identification information.

The erasing of the player identification information is performed in the procedure described below. First, the chip identification information is read out from the gaming chip by the erasing antenna device 52. The second control unit 400 of the game table 20 transmits the read-out chip identification information to the management server 600. The management server 600 erases from the database the player identification information which is associated with the received chip identification information. Thus, the correspondence relation (linkage) between the chip identification information and the player identification information is cancelled and deactivated. The gaming chip is returned from a player to a game facility and is brought into a state in which the gaming chip is kept in a game facility.

The registration of the player identification information is performed in the procedure described below. First, the chip identification information is read out from the gaming chip by the registration antenna device 56. The second control unit 400 of the game table 20 transmits to the management server 600 the read-out chip identification information and the player identification information corresponding to the gaming chip. The management server 600 receives the chip identification information and the player identification information, associates the player identification information with the chip identification information, and stores in the database the player identification information associated with the chip identification information. Thus, a correspondence relation (linkage) between the chip identification information and the player identification information is formed and activated. The gaming chip is lent out to a player from a game facility and is brought into a state in which the gaming chip is held by a player.

The reference antenna device 54 is an antennas for allowing a dealer to confirm the gaming chip. A dealer takes out gaming chips from the chip tray 28, conducts a registration process, and thereafter, deals out the gaming chips to players. The dealer can confirm by the reference antenna device 54 whether or not the gaming chips are gaming chips which have undergone the registration process.

In addition, when a dealer collects the gaming chips from players, a dealer conducts an erasing process and thereafter, the gaming chips are housed in the chip tray 28. Before housing the gaming chips in the chip tray 28, a dealer can confirm by the reference antenna device 54 whether or not the gaming chips are gaming chips which have undergone the erasing process.

<<Dealer Display 26>>

On a right end portion of the dealer part of the game table 20, a dealer display 26 is provided. Connected to the dealer display 26 are the second control unit 400 of the game table 20 and the like. On the dealer display 26, a variety of information such as the identification information of a player, other gaming chip information, and information of a game are displayed.

<<Chip Tray 28>>

The chip tray 28 is provided in the front of the dealer part 30. The chip tray 28 is configured so as to be detachable with respect to the game table 20. In the chip tray 28, gaming chips to be dealt out to a player and gaming chips collected from a player are housed. When a dealer leaves the game table 20, a dealer detaches the chip tray 28 and carries the whole of the chip tray 28 with him or her. The gaming chips housed in the chip tray 28 are managed by a game facility such as a dealer.

<<Chip Stocker 60>>

On a left side of a dealer situated at the game table 20, a chip stocker 60 is located. The chip stocker 60 is arranged in the vicinity of the erasing antenna device 52. In the chip stocker 60, spare gaming chips for use by a dealer are housed. All of the gaming chips housed in the chip stocker 60 are deactivated.

<Antenna Module 430 and Controller 450>

As shown in FIG. 2, the game table apparatus 100 includes: the second control unit 400 and the antenna module 430. The antenna module 430 has an antenna board 432 and the controller 450.

The antenna 434 is formed on the antenna board 432 and is provided in the antenna module 430. As described above, the gaming chips are placed on the game table 20 by players and a dealer. The antenna 434 wirelessly communicates with an IC tag for RFID of each of the gaming chips placed on the game table 20.

As described above, the game table apparatus 100 is provided with the plurality of antenna modules 430 which correspond to the game areas 42 and the dealer area 44. It is to be noted that in FIG. 2, one antenna module 430 is representatively illustrated.

The controller 450 is communicatively connected to the second control unit 400. In accordance with an instruction received from the second control unit 400, the controller 450 communicates with the IC tag for RFID of each of the gaming chips via the antenna 434. The controller 450 receives the chip identification information from the IC tag for RFID. The controller 450 transmits the chip identification information to the second control unit 400.

The controller 450 is constituted of, for example, a microcomputer having a CPU, a ROM, and a RAM (not shown). The controller 450 has a modulation part 452 and a demodulation part 454. The controller 450 is constituted of, for example, an RF module having a modulation circuit and a demodulation circuit.

Based on information such as a predetermined command, request, and instruction received by the controller 450, the modulation part 452 modulates a carrier wave in a predetermined modulation method, generates a modulation wave (modulation signal), and outputs an RF signal obtained by the modulation. The outputted RF signal is supplied to the antenna 434 and is emitted as an electromagnetic wave from the antenna 434.

The modulation wave received by the antenna 434 is supplied as a modulation signal to the demodulation part 454. This modulation wave is an electromagnetic wave obtained by modulating the carrier wave in the predetermined modulation method based on the chip information stored in the IC tag for RFID of each of the gaming chips. The demodulation part 454 demodulates the modulation signal supplied from the antenna 434 and reads out the chip information stored in the IC tag for RFID.

As described above, the controller 450 transmits and receives the electromagnetic wave via the antenna 434 of the antenna board 432 and is thereby capable of wirelessly communicating with the IC tag for RFID of each of the gaming chips placed on the bet regions.

<<Card Shoe 310>>

Figure 5:
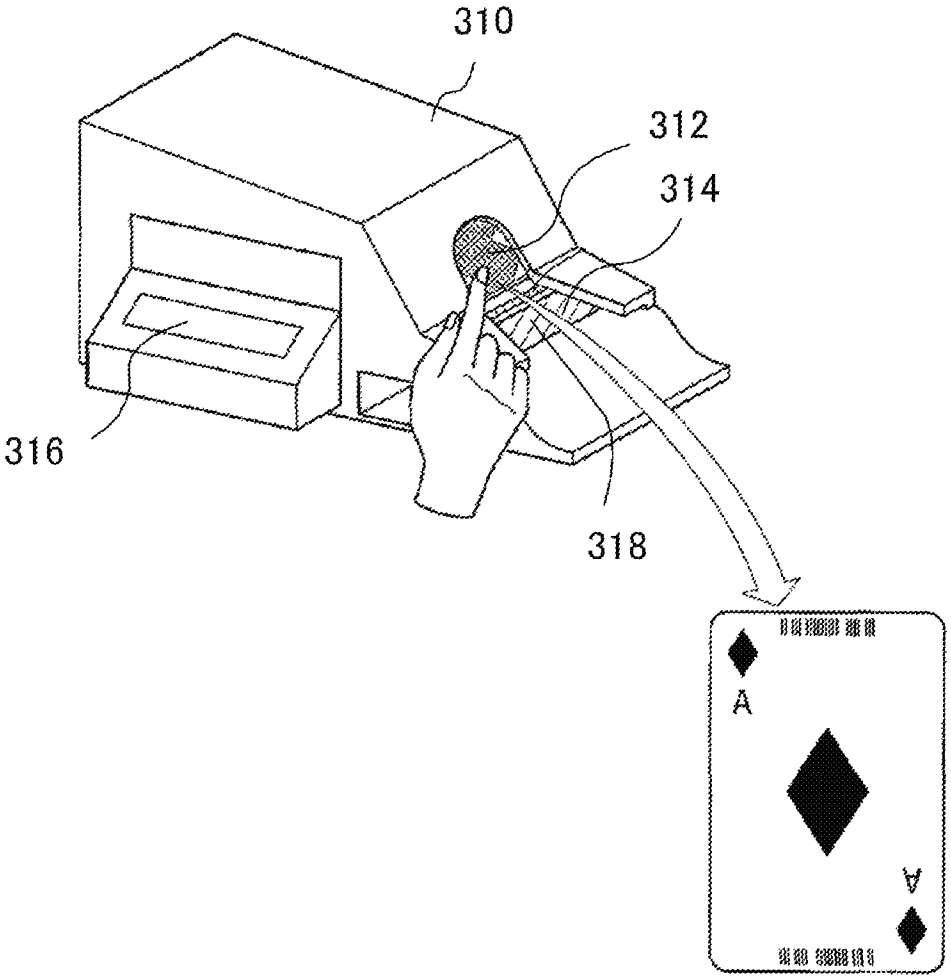
FIG. 5 is a perspective view illustrating the whole of a card shoe 310.
Figure 6:
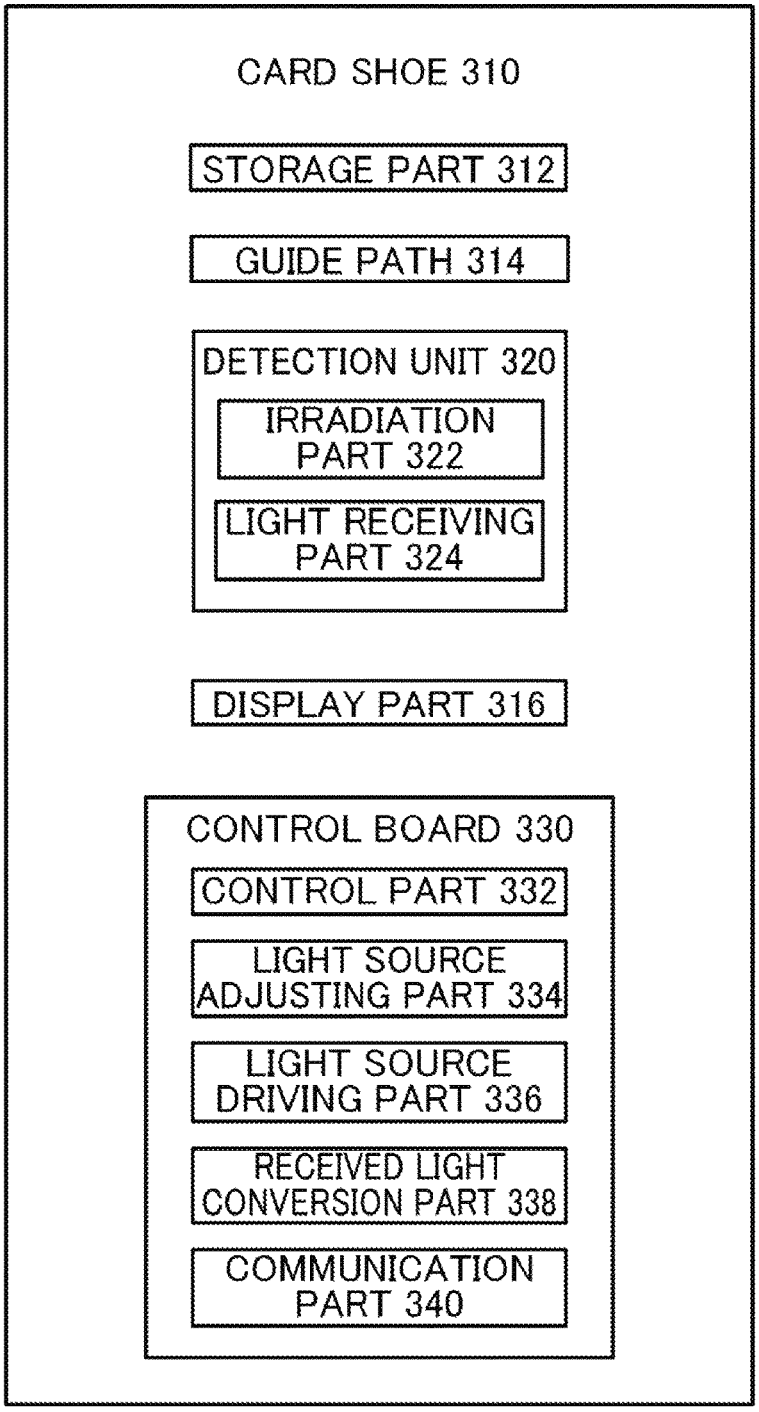
FIG. 6 is a functional block diagram illustrating an outline of the card shoe 310.

As shown in FIG. 3 and FIG. 4, on the chip stocker 60, the card shoe 310 is located. As shown in FIG. 2, FIG. 5, and FIG. 6, the card shoe 310 has a storage part 312, a guide path 314, a detection unit 320, a display part 316, and a control board 330.

The storage part 312 keeps a plurality of gaming cards in a state in which the gaming cards are stacked. In the storage part 312, the gaming cards are kept face down. The storage part 312 has a number-of-card detection sensor (not shown) capable of detecting a number of the gaming cards stored therein.

The guide path 314 guides gaming cards pulled out from the storage part 312 to a card ejection end 318.

The display part 316 displays identification information of each of the gaming cards. The identification information of each of the gaming cards is identified by the later-described control board 330. The identification information of each of the gaming cards is information unique to each of the gaming cards and includes suit information and numerical information. On each of the gaming cards, the suit information and the numerical information are depicted. The suit information is constituted of four kinds of pieces of information composed of hearts, diamonds, clubs, and spades. The numerical information is constituted of 13 kinds of pieces of information composed of numerals of 2 to 10, J (JACK), Q (QUEEN), K (KING), and A (ACE).

The detection unit 320 has an irradiation part 322 and a light receiving part 324. The irradiation part 322 emits infrared light. Each of the gaming cards is irradiated with the infrared light emitted from the irradiation part 322. Each of the gaming cards is moved manually by a dealer on the guide path 314. The infrared light is emitted toward each of the gaming cards located on the guide path 314.

The light receiving part 324 receives reflected light of the infrared light emitted to each of the gaming cards. The light receiving part 324 is constituted of a plurality of light receiving elements (not shown) which are long. The plurality of light receiving elements are arranged in an arrayed manner and are located in parallel with a longitudinal direction of each of the gaming cards moving on the guide path 314. As described above, on each of the gaming card, the suit information and the numerical information are depicted, and the reflected light includes the suit information and the numerical information.

The control board 330 has a control part 332, a light source adjusting part 334, a light source driving part 336, a received light conversion part 338, and a communication part 340.

The control part 332 is constituted of a CPU, a ROM, a RAM (any thereof not shown), and the like. The light source adjusting part 334 adjusts a light emission amount of the infrared light emitted from the irradiation part 322. The light source driving part 336 emits the infrared light when each of the gaming cards is located on the guide path 314. The received light conversion part 338 converts a light amount of the reflected light received by the light receiving part 324 to an analog signal and outputs the analog signal to an analog/digital converter (not shown). The control part 332 converts image data obtained from a digital signal to identification information of each of the gaming cards.

The communication part 340 is communicatively connected to the first control unit 200. The communication part 340 outputs the identification information of each of the gaming cards to the first control unit 200. The first control unit 200 determines the progress of a game from the suit information and the numerical information included in the identification information of each of the gaming cards. This processing will be described with reference to the later-described FIG. 8 to FIG. 10.

In addition, when a number of the gaming cards stored in the storage part 312 comes to be equal to or less than a predetermined number, the communication part 340 outputs a card replenishing signal, which prompts the replenishment of gaming cards, to the first control unit 200.

As described above, on the display part 316, the identification information of each of the gaming cards identified by the control board 330 is displayed. A dealer can confirm whether or not the identification information displayed on the display part 316 matches the identification information of each of the gaming cards taken out from the card shoe 310.

The control board 330 performs the conversion to the identification information of each of the gaming cards based on the analog signal outputted from the detection unit 320. However, the conversion to information which is different from the identification information of each of the gaming cards taken out may be made depending on a state of the detection unit 320, a state of each of the gaming cards, and a state of the guide path 314. In addition, the conversion to the identification information of each of the gaming cards cannot be made and an error may thereby occur. For example, the conversion of the identification information of each of the gaming cards receives may be influenced by dirt adhering to each of the gaming cards and dust attached to the detection unit 320.

Therefore, a dealer visually confirms whether or not the information displayed on the display part 316 matches the identification information of each of the gaming cards actually taken out. When the identification information displayed on the display part 316 is different from the identification information of each of the gaming cards actually taken out, a dealer operates the keyboard 222 and inputs the identification information of each of the gaming cards actually taken out. The identification information of each of the gaming cards inputted from the keyboard 222 is outputted to the first control unit 200 as valid identification information and is stored in the RAM 216, thereby determining an outcome of a game. Thus, fairness of a game can be maintained.

The above-described card shoe 310 optically acquires the identification information of each of the gaming cards by using the detection unit 320. In recent years, there is a case where gaming cards each having an RFID tag incorporated therein are used. The RFID tag has identification information of a gaming card stored therein. When the gaming cards each having the RFID tag incorporated therein are used, it is only required to provide an antenna for reading the RFID tag for the card shoe 310 or the game table 20 and to read out the identification information of each of the gaming cards from the RFID tag.

Further, also when the gaming cards each having the RFID tag incorporated therein are used, the identification information of each of the gaming cards may be read out from the RFID tag and the identification information of each of the gaming cards may be optically detected. By comparing the both pieces of identification information, true identification information of each of the gaming cards can be easily determined.

Furthermore, there may be a case where a monitoring camera (not shown) is provided for the game table 20. Each of the gaming cards may be shot by such a monitoring camera and the pieces of identification information of the gaming cards may be compared. Thus, true identification information of each of the gaming cards can be further easily determined.

<<<Specific Example of Image Displayed on Game Outcome Notification Display 300>>>

Figure 7:
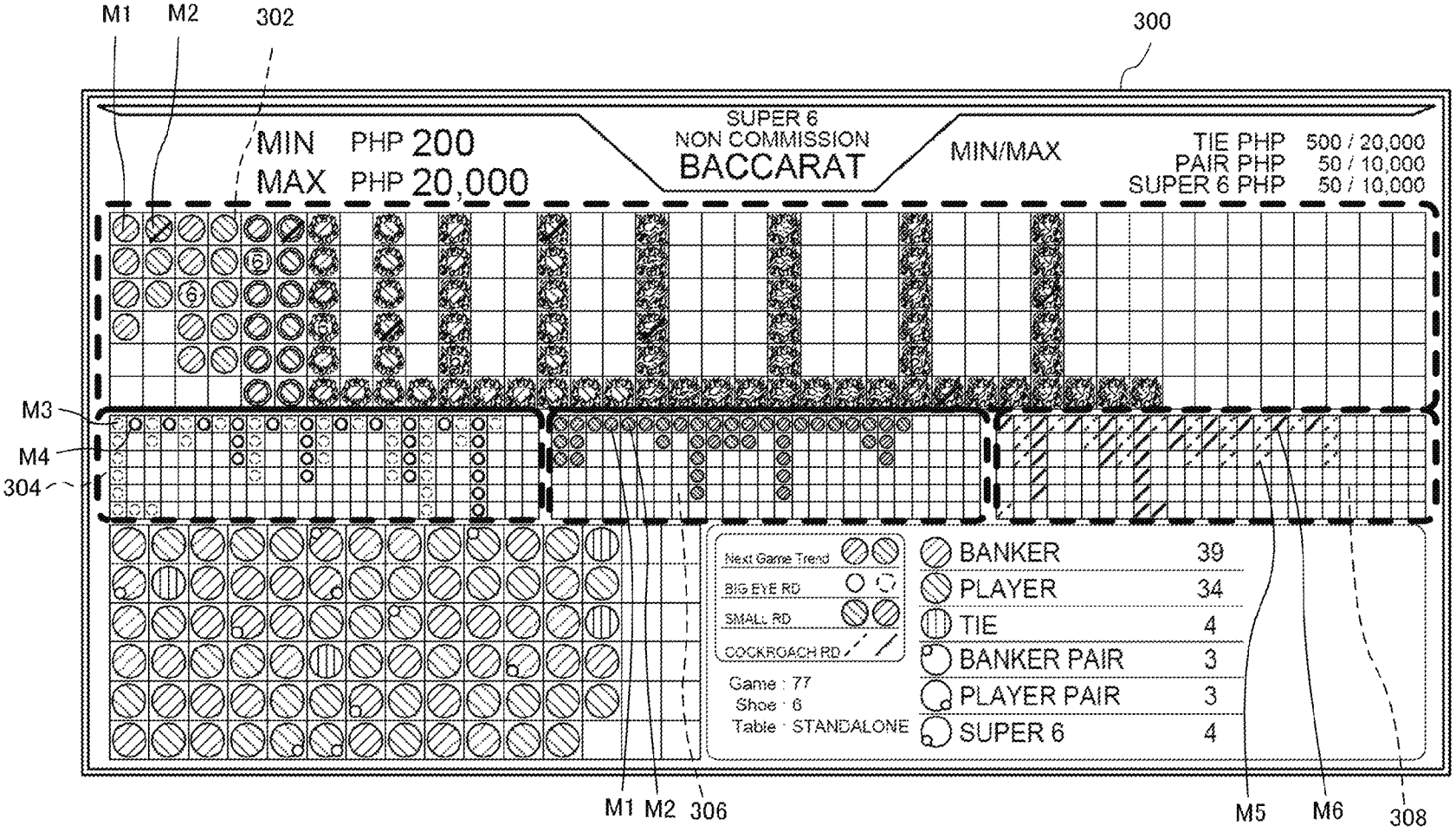
FIG. 7 is a diagram illustrating an example of an image displayed on a game outcome notification display 300.

FIG. 7 is a diagram illustrating an example of an image displayed on the game outcome notification display 300. When baccarat is played on the game table 20, the image shown in FIG. 7 is displayed on the game outcome notification display 300.

The baccarat is a game in which a virtual banker and a virtual player have a match. Specifically, the baccarat is a game in which a real player forecasts which card between a gaming card dealt to the virtual banker and a gaming card dealt to the virtual player is close to 9. The real player forecasts which one of the virtual banker and the virtual player wins.

As described above, the baccarat is a game in which any one thereof is determined as a winner. The game outcome notification display 300 functions as a device for causing the real player to visually recognize an outcome of the game (winner) and other information related to the game.

In the example shown in FIG. 7, in the central portion of the uppermost part, characters "SUPER 6", "NON COMMISSION", and "BACCARAT" are displayed, thereby allowing the real player to visually recognize that the baccarat is being played on the game table 20.

As shown in FIG. 7, in the baccarat, on the game outcome notification display 300, an image having four display regions is displayed. In a first display region, a big road 302 is displayed; in a second display region, a big eye road 304 is displayed; in a third display region, a small road 306 is displayed; and in a fourth display region, a cockroach road 308 is displayed. These big road 302, big eye road 304, small road 306, and cockroach road 308 are referred to as ruled lines and are tables of records in the baccarat, and the history of winning or losing in the game is displayed on each of the display regions.

<Big Road 302>

The big road 302 is a basic table of records showing outcomes of games in the baccarat. The big road 302 shown in FIG. 7 is constituted of a matrix composed of 40 cells in a horizontal direction and six cells in a vertical direction. An outcome of one game (winner) is displayed in one cell.

On the big road 302 shown in FIG. 7, when the virtual banker has won, a circular mark with left-downward hatching (hereinafter, referred to as a mark MD is displayed, and when the virtual player has won, a circular mark with right-downward hatching (hereinafter, referred to as a mark M2) is displayed. It is to be noted that ordinarily, the virtual banker is indicated in red and the virtual player is indicated in blue. In this specification, the mark M1 is synonymous with a red mark and the mark M2 is synonymous with a blue mark.

On the big road 302 shown in FIG. 7, an image of successive winning presentation is also displayed so as to be superimposed on each of the marks M1 and M2. With reference to FIG. 13A to FIG. 17B, the images of the successive winning presentation will be specifically described, and with reference to FIG. 8 to FIG. 12, the processes of the successive winning presentation will be described. In FIG. 7, the virtual banker is indicated by the mark M1 (left-downward hatching) and the virtual player is indicated by the mark M2 (right-downward hatching). However, in FIG. 13A to FIG. 17B, in order to facilitate clear illustration of the presentation, the hatching is omitted.

On the big road 302 shown in FIG. 7, when the total number of dealt gaming cards is 6 and winning occurs, a numeral "6" is displayed on each of the marks M1 and M2.

On the big road 302, when either one of the virtual banker and the virtual player has successively won, the marks M1 or M2 each indicating the winner are displayed so as to neighbor to one another.

In addition, when the winner has changed, on an uppermost cell of a right-hand neighboring column, the mark is displayed. In a case of a tie, a slash mark is displayed in a cell.

By viewing the big road 302, the real player can determine whether the virtual banker has successively won, whether the virtual player has successively won, or whether bias with respect to winning or losing of the both sides has occurred.

On the big road 302 shown in FIG. 7, the first column from the left indicates four successive wins. The second column indicated three successive wins.

Figure 13A:
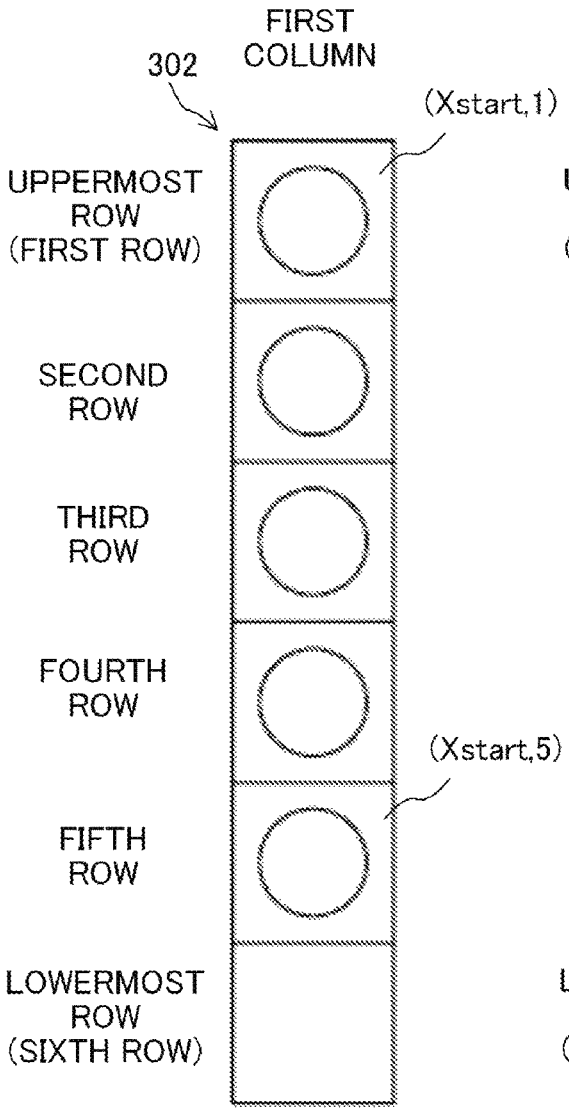
FIGS. 13A and 13B are diagrams illustrating an example of a specific image of successive winning presentation displayed on the game outcome notification display 300.
Figure 13B:
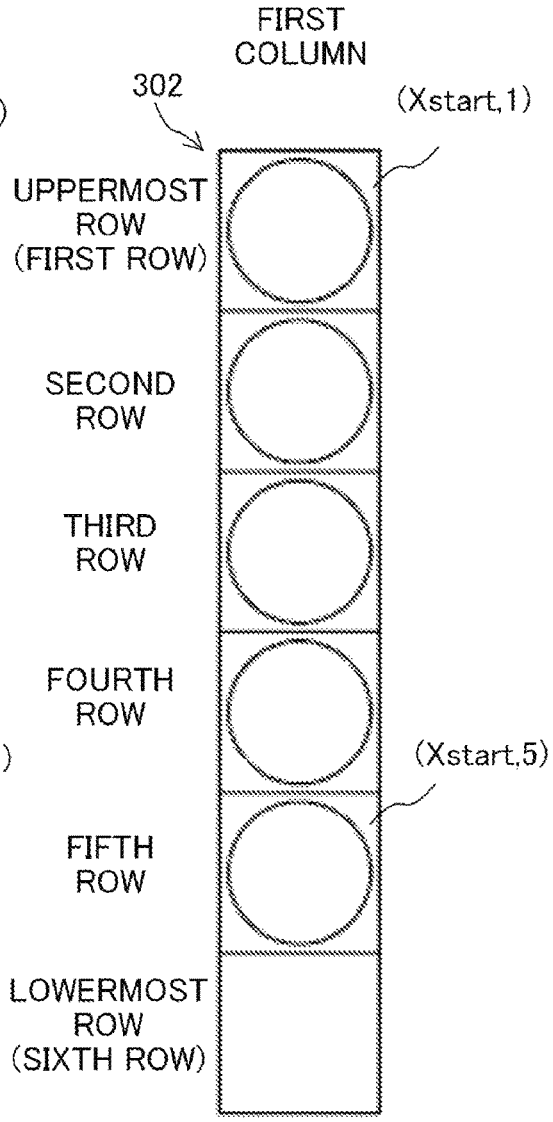

Each of the third column and the fourth column indicates five successive wins, respectively (refer to FIGS. 13A and 13B). Each of the fifth column and the sixth column indicates six successive wins, respectively (refer to FIGS. 14A and 14B). Each of the seventh column to eighth column and the ninth column to 10th column indicates seven successive wins, respectively (refer to FIGS. 15A and 15B).

Figure 16A:
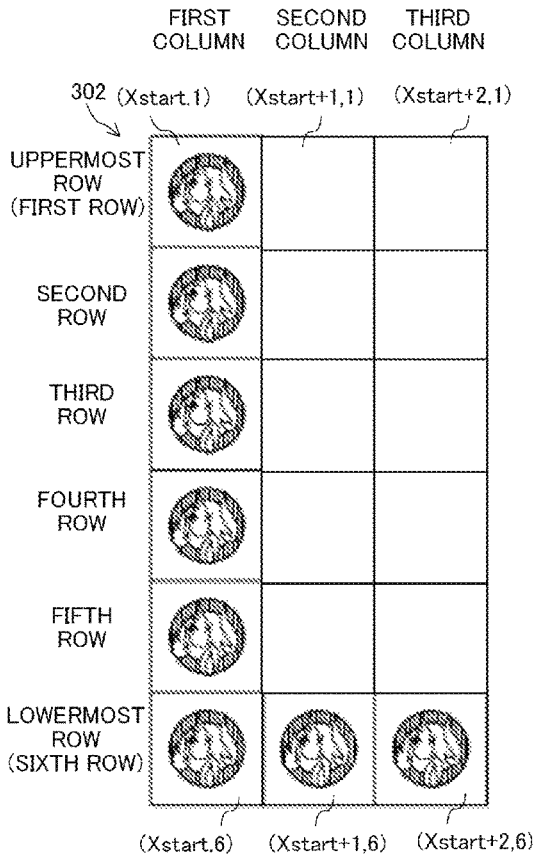
FIGS. 16A and 16B are diagrams illustrating an example of a specific image of successive winning presentation displayed on the game outcome notification display 300.
Figure 16B:
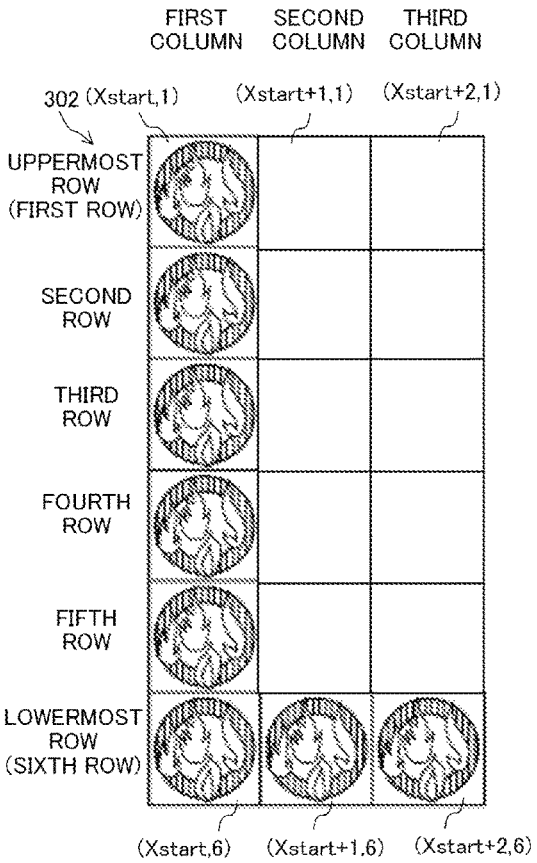

Each of the 11th column to 13th column and the 14th column to 16th column indicates eight successive wins, respectively (refer to FIGS. 16A and 16B). Each of the 17th column to 20th column, the 21th column to 24th column, the 25th column to 28th column, and the 29th column to 32th column indicates nine successive wins, respectively (refer to FIGS. 17A and 17B).

As shown in the first column to sixth column, the marks are successively displayed along the same column until the six successive wins occur. As shown in the seventh column to 32th column, when seven or more successive wins have occurred, the marks are successively displayed along the lowermost row(s) toward the right side. By displaying the marks as described above, when the seven or more successive wins have occurred, on the big road 302, a group of the marks is formed so as to be L-shaped.

On the big road 302, in accordance with an increase in the number of successive wins, the presentation which makes the increase conspicuous is executed. In FIG. 7, the successive winning presentation and the original presentation are shown in the same diagram in order to allow the differences between the successive winning presentation and the original presentation to be compared. As described below, when the successive winning has been completed, the presentation is returned to the original presentation. The details of the successive winning presentation will be described later.

<Big Eye Road 304>

The big eye road 304 is a table of records showing whether winning or losing is "the same move" or "a different move", by comparing "the latest winner" and "the winner in the first preceding column" on the big road 302. The big eye road 304 shown in FIG. 7 is constituted of a matrix composed of 25 cells in a horizontal direction and six cells in a vertical direction. As on the big road 302, an outcome of one game is displayed in one cell. On the big eye road 304, a tie is not counted.

On the big eye road 304 shown in FIG. 7, when the winning or losing is the same move, a broken line circular mark (hereinafter, referred to as a mark M3) is displayed, and when the winning or losing is a different move, a thick solid line circular mark (hereinafter, referred to as a mark M4) is displayed.

The big eye road 304 starts at a point in time when a record is indicated in either of "the second row of the second column" or "the first row of the third column".

As described above, when the winning or losing is the same move, the mark M3 is displayed, and when the winning or losing is a different move, the mark M4 is displayed. In addition, when it is impossible to compare "the latest winner" and "the winner in the first preceding column", it is determined whether or not successive winning occurs as it is. When the successive winning has occurred, the mark M3 is displayed, and when the successive winning has not occurred, the mark M4 is displayed.

<Small Road 306>

The small road 306 is a table of records showing whether winning or losing is "the same move" or "a different move", by comparing "the latest winner" and "the winner in the column prior to the first preceding column" on the big road 302. The small road 306 shown in FIG. 7 is constituted of a matrix composed of 25 cells in a horizontal direction and six cells in a vertical direction. As on the big road 302, an outcome of one game is displayed in one cell. On the small road 306, a tie is not counted.

On the small road 306 shown in FIG. 7, as on the big eye road 304, when the winning or losing is the same move, a circular mark with left-downward hatching (hereinafter, referred to as a mark M1) is displayed, and when the winning or losing is a different move, a circular mark with right-downward hatching (hereinafter, referred to as a mark M2) is displayed.

On the small road 306, "the latest winner" and "the winner in the column prior to the first preceding column" on the big road 302 are compared. Therefore, the small road 306 starts at a point in time when a record is indicated in either of "the second row of the third column" or "the first row of the fourth column".

As described above, when the winning or losing is the same move, the mark M1 is displayed, and when the winning or losing is a different move, the mark M2 is displayed. In addition, when it is impossible to compare "the latest winner" and "the winner in the column prior to the first preceding column", it is determined whether or not successive winning occurs as it is. When the successive winning has occurred, the mark M1 is displayed, and when the successive winning has not occurred, the mark M2 is displayed.

<Cockroach Road 308>

The cockroach road 308 is a table of records showing whether winning or losing is "the same move" or "a different move", by comparing "the latest winner" and "the winner in the column prior to the column prior to the first preceding column" on the big road 302. The cockroach road 308 shown in FIG. 7 is constituted of a matrix composed of 25 cells in a horizontal direction and six cells in a vertical direction. As on the big road 302, an outcome of one game is displayed in one cell. On the cockroach road 308, a tie is not counted.

On the cockroach road 308 shown in FIG. 7, as on the big eye road 304 and the small road 306, when the winning or losing is the same move, a broken line slash (hereinafter, referred to as a mark M5) is displayed, and when the winning or losing is a different move, a solid line slash (hereinafter, referred to as a mark M6) is displayed.

On the cockroach road 308, "the latest winner" and "the winner in the column prior to the column prior to the first preceding column" on the big road 302 are compared. Therefore, the cockroach road 308 starts at a point in time when a record is indicated in either of "the second row of the fourth column" or "the first row of the fifth column".

As described above, when the winning or losing is the same move, the mark M5 is displayed, and when the winning or losing is a different move, the mark M6 is displayed. In addition, when it is impossible to compare "the latest winner" and "the winner in the column prior to the column prior to the first preceding column", it is determined whether or not successive winning occurs as it is. When the successive winning has occurred, the mark M5 is displayed, and when the successive winning has not occurred, the mark M6 is displayed.

As described above, on the game outcome notification display 300, the outcomes of games are displayed in the plurality of display regions based on criteria which are different from one another.

As shown in FIG. 7, in the lower portion thereof, a variety of pieces of information pertinent to the games such as "BANKER 39", "PLAYER 34", "TIE 4", "BANKER PAIR 3", "PLAYER PAIR 3", and "SUPER6 4" are also displayed.

<<<Process of Successive Winning Presentation>>>

Figure 8:
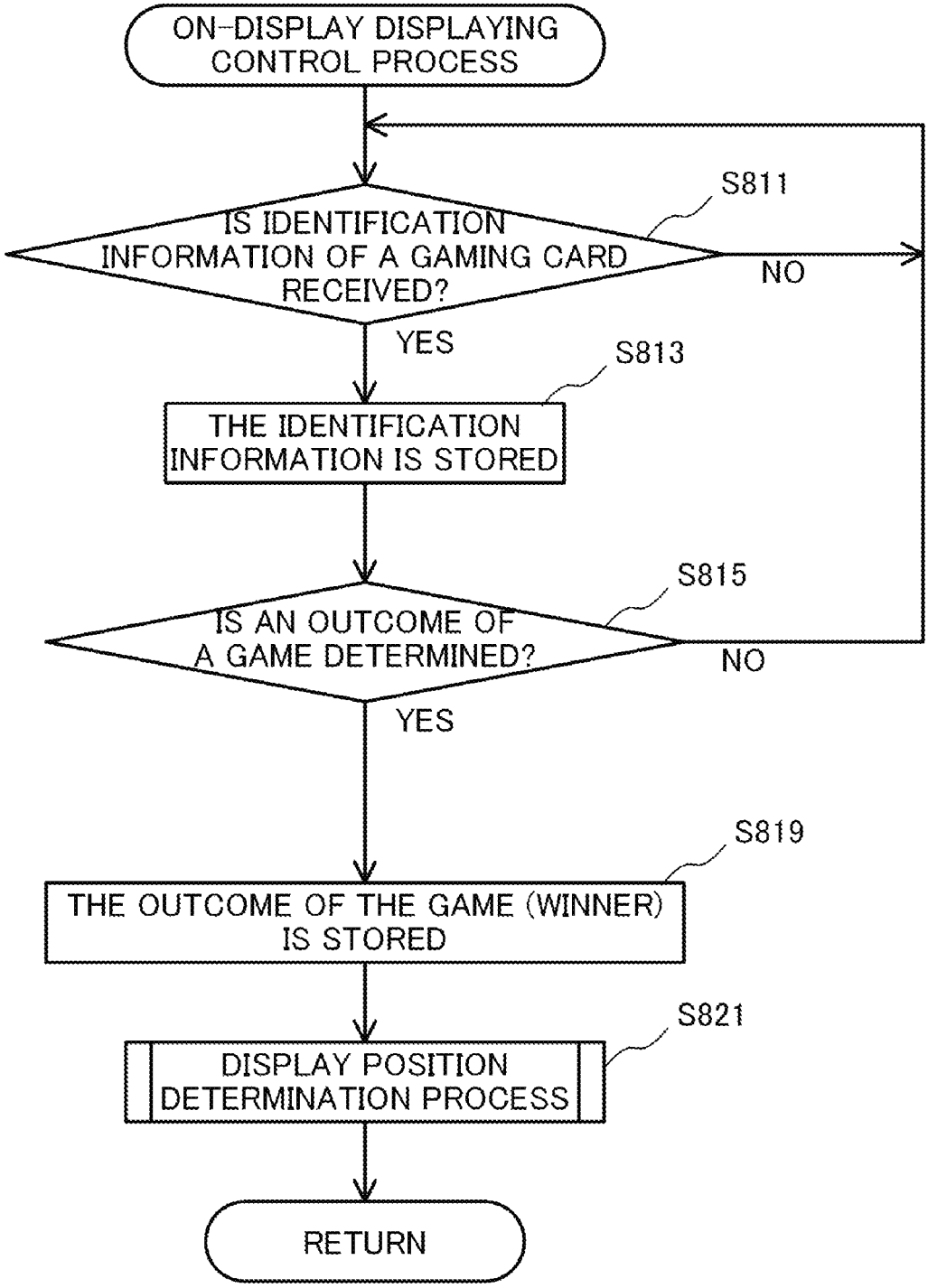
FIG. 8 is a flowchart showing an example of an on-display displaying control process.

FIG. 8 is a flowchart showing an example of an on-display displaying control process. This process is executed in the first control unit 200.

First, a CPU 212 of the first control unit 200 determines whether or not identification information of a gaming card transmitted from the card shoe 310 is received (step S811). As described above, as the pieces of the identification information of the gaming cards, 13 kinds of pieces of numerical information and four kinds of pieces of suit information are included.

When a dealer takes out a gaming card from the card shoe 310, the identification information of the gaming card taken out is outputted from the card shoe 310. The process at step S811 is a process for receiving the identification information of the gaming card taken out by a dealer. By this process, the first control unit 200 can obtain the suit information and the numerical information of the gaming card from the card shoe 310.

As described above, there may be a case where the information converted by the control board 330 is different from identification information of an actual gaming card taken out from the card shoe 310. In this case, the first control unit 200 receives identification information of the gaming card inputted by the operation of a dealer.

When the CPU 212 determines that the identification information of the gaming card has not been received, the CPU 212 returns the process to step S811.

When the CPU 212 determines that the identification information of the gaming card has been received, the CPU 212 stores and accumulates the identification information of the gaming card in a RAM 216 (step S813).

The CPU 212 determines whether or not an outcome of the game is determined from the plurality of pieces of identification information accumulated in the RAM 216 (step S815).

For example, when the game is baccarat, the outcome of the game is a winner. The winner is either of a virtual banker or a virtual player. The gaming cards are dealt to the virtual banker and the virtual player, and from the dealt gaming cards, the winner is determined.

When the CPU 212 determines in the determination process at step S815 that the outcome of the game is not determined, the CPU 212 returns the process to step S811. In other words, when no winner can be determined only by the currently accumulated pieces of identification information of the gaming cards and it is required to further continue the game, the CPU 212 returns the process to step S811 and takes out the next gaming card from the card shoe 310.

When the CPU 212 determines in the determination process at step S815 that the outcome of the game is determined from the plurality of pieces of identification information accumulated in the RAM 216, the CPU 212 stores the determined outcome of the game in the RAM 216 (step S819). Specifically, information showing the winner (the virtual banker or the virtual player) is stored as the outcome of the game in the RAM 216.

Next, the CPU 212 calls and executes a subroutine of a display position determination process shown in the later-described FIG. 9 (step S821), finishing this subroutine. The subroutine of the display position determination process is a process for displaying the mark indicating the winner on the big road 302.

<<<Display Position Determination Process>>>

FIG. 9 is a flowchart showing an example of the display position determination process. This process is called in the process at the above-described step S821 and is executed. This process is a process for displaying the mark indicating the winner on the big road 302.

First, the CPU 212 of the first control unit 200 determines whether or not the winner has changed from the winner in the previous game (step S911).

When the CPU 212 determines that the winner is different from the winner in the previous game, a subroutine of the later-described display mode recovery process is called and executed (step S912).

By the display mode recovery process, on the big road 302, the display mode of the mark indicating the winner is returned to the normal display mode, and the mark in the normal display mode is displayed. The mark in the normal display mode is a circular mark having a fixed size. In other words, the mark in the normal display mode is a circular mark in a still display mode whose size does not change temporally. As described below, when five successive wins or more have occurred, the mark indicating the winner is displayed in a moving display mode (the first display mode to fifth display mode). As far as the successive winning continues in games after the occurrence of the five successive wins, the mark indicating the winner is displayed in the moving display mode. On the other hand, when in the game after the occurrence of the five successive wins or more, the winner is changed and the successive winning is finished, the display mode of the mark indicating the winner is returned from the moving display mode to the still display mode, and the mark indicating the winner in the still display mode is displayed.

Next, the CPU 212 changes a display color (step S913). As described above, in general, the virtual banker is indicated in red and the virtual player is indicated in blue. In FIG. 7, in order to facilitate clear distinguishing, the virtual banker is indicated by the mark M1 (with the left-downward hatching) and the virtual player is indicated by the mark M2 (with the right-downward hatching). Hereinafter, however, the description will be made by using general red and blue. As described above, in this specification, a red mark is synonymous with the mark M1 in FIG. 7 and a blue mark is synonymous with the mark M2 in FIG. 7.

When the virtual banker has won in the previous game and the virtual player has won in the current game, the display color is changed from red to blue. In addition, when the virtual player has won in the previous game and the virtual banker has won in the current game, the display color is changed from blue to red.

Next, the CPU 212 changes a position of a cell (X, Y), where the mark indicating the winner is displayed, to a position of a cell (X+1, Y) (step S915). The value X shows the position of a cell in a horizontal direction (lateral direction) on the big road 302 and increases toward a right direction on the big road 302. The value Y shows the position of a cell in a vertical direction (longitudinal direction) on the big road 302 and increases toward a downward direction on the big road 302.

In the process at step S915, since the winner has changed, in order to display the mark in a new column, the position of the cell (X, Y) is changed to the position of the cell (X+1, Y) which shows a position of the first row (uppermost row) of a right-hand neighboring column.

Next, the CPU 212 changes Xstart to X (step S917). The Xstart shows a position of a new column (first column) when the winner has changed and the display of the mark from a new column is started (refer to FIG. 13A to FIG. 17B). As described below, when the winner has changed, there may be a case where the presentation so far conducted is returned to the original one. In the present embodiment, the presentation is returned to the original one by using the Xstart.

When the CPU 212 determines in the determination process at step S911 that the winner in the current game is the same as the winner in the previous game, the CPU 212 counts a number of successive wins (step S919).

Next, the CPU 212 determines whether or not the number of successive wins is seven or more. In other words, the CPU 212 determines whether the virtual banker has won successively at seven times or more or the virtual player has won successively at seven times or more (step S921).

When the CPU 212 determines in the determination process at step S921 that the number of successive wins is less than seven, the CPU 212 changes the position of the cell (X, Y), where the mark is displayed, to a position of a cell (X, Y+1) (step S923). In other words, the display position of the mark is set to a cell immediately below the cell where the mark is currently displayed in the same first column. At this point in time, since the position of the cell (X, Y) where the mark indicating the winner is displayed is in the first column, X is the same as Xstart. As shown in FIG. 13A to FIG. 14B, when the number of successive wins is less than seven (up to six successive wins), the mark indicating the winner is displayed only in the first column (Xstart).

On the other hand, when the CPU 212 determines in the determination process at step S921 that the number of successive wins is seven or more, the CPU 212 changes the position of the cell (X, Y), where the mark is displayed, to a position of a cell (X+1, 6) (step S925). In other words, the display position of the mark is set to a cell in the sixth row (lowermost row) in a right-hand neighboring column which is the second column and the subsequent columns.

Figure 15A:
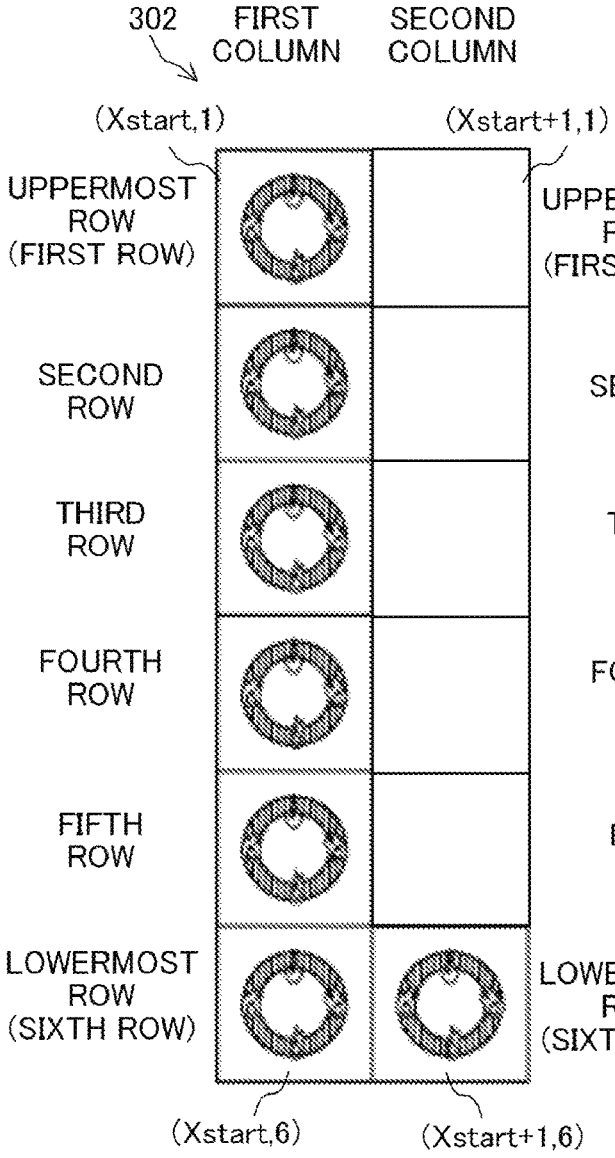
FIGS. 15A and 15B are diagrams illustrating an example of a specific image of successive winning presentation displayed on the game outcome notification display 300.
Figure 15B:
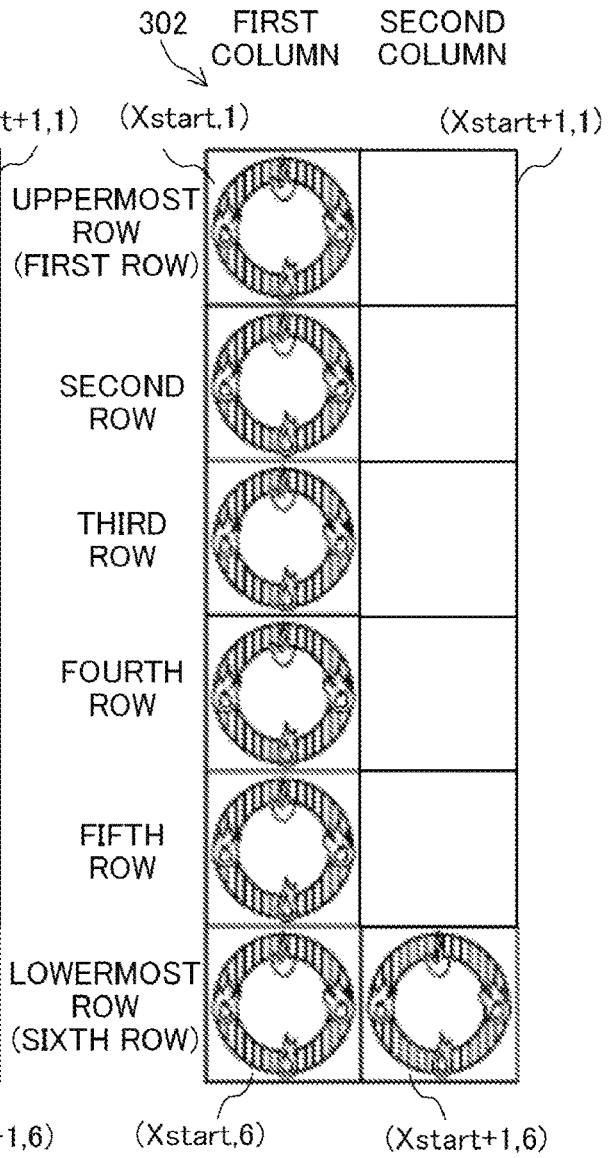
Figure 17A:
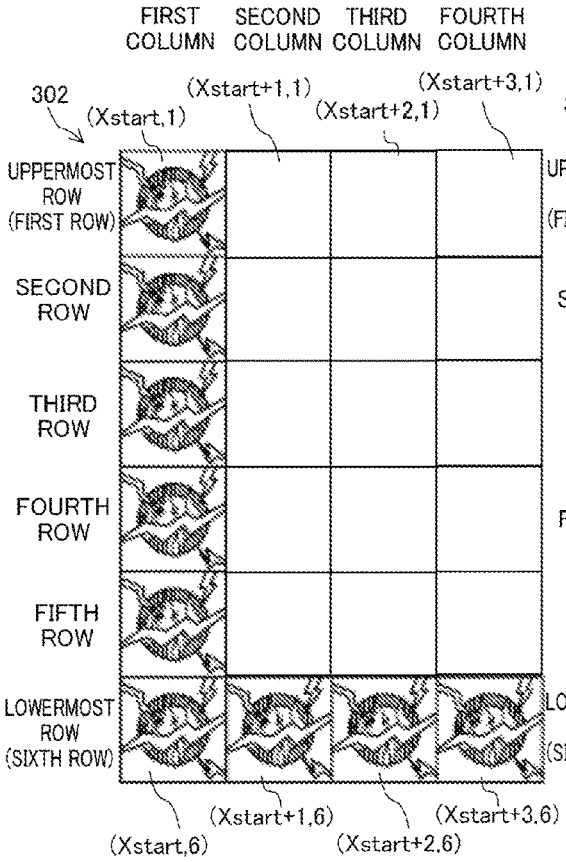
FIGS. 17A and 17B are diagrams illustrating an example of a specific image of successive winning presentation displayed on the game outcome notification display 300.
Figure 17B:
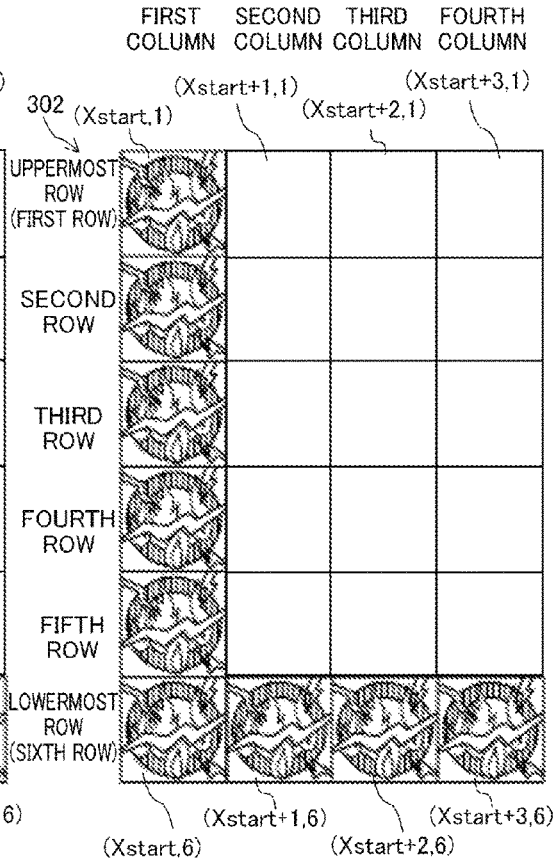

For example, when the seven successive wins have occurred, as shown in FIGS. 15A and 15B, a new seventh mark is displayed in a cell (Xstart+1, 6) in the sixth row (lowermost row) of the second column (Xstart+1). In addition, when eight successive wins have occurred, as shown in FIGS. 16A and 16B, a new eighth mark is displayed in a cell (Xstart+2, 6) in the sixth row (lowermost row) of the third column (Xstart+2). Similarly, when nine successive wins have occurred, as shown in FIGS. 17A and 17B, a new ninth mark is displayed in a cell (Xstart+3, 6) in the sixth row (lowermost row) of the fourth column (Xstart+3).

By the above-described processes at step S923 and S925, until up to the six successive wins have occurred, each time the winning occurs, a number of the cell(s) where the mark(s) is/are displayed increases by one (refer to FIG. 13A to FIG. 14B) in the first column. Further, when the number of successive wins is seven or more, each time the winning occurs, a number of the cell(s) where the mark(s) is/are displayed increases by one in each of the lowermost rows of the second and subsequent columns (refer to FIG. 15A to FIG. 17B). By conducting the display as described above, upon the occurrence of the seven successive wins or more, the whole shape of the marks each indicating the winner is L-shaped, and a state where the successive wins have occurred can be clearly shown on the big road 302.

After the occurrence of the seven successive wins or more, when the successive winning has stopped and the winner has changed, by the processes at step S911 and S915, the position where the mark is displayed is changed to a position in the uppermost row of a right-hand neighboring column as a new first column. Since the marks are displayed as described above, when the number of successive wins is seven or more, as shown in FIG. 15A to FIG. 17B, marks are not displayed in five cells in an upper most row (the first row) to the fifth row of the second and subsequent columns, thereby allowing empty cells (vacant regions) to be formed. The vacant regions are formed in an upper portion of the big road 302, thereby allowing the occurrence of the seven successive wins or more to be clearly shown (refer to the eighth column to 32th column in FIG. 7).

After executing the above-described processes at step S923 and S925, a subroutine of the later-described display mode change process is called and executed (step S926).

After executing the above-described processes at step S917 and S926, the position (X, Y) where the mark is displayed and the display color are stored in the RAM 216 (step S927), finishing this subroutine.

<<<Display Mode Change Process>>>

FIG. 10 is a flowchart showing an example of a display mode change process. This process is called in the above-described process at step S926 and is executed. The process shown in FIG. 9 is the process for determining a position where the mark indicating the winner is displayed. The process shown in FIG. 10 is the process for changing a display mode in which the mark indicating the winner whose number of successive wins is five or more is displayed.

First, when the CPU 212 of the first control unit 200 determines that the successive winning has occurred, the CPU 212 determines whether or not the five successive wins have occurred (step S1019).

When the CPU 212 determines that the five successive wins have occurred, the CPU 212 displays pieces of image data in a first display mode in all of the mark display positions of the first to fifth successive wins (step S1021), finishing this subroutine. The position of the mark where the successive winning has started is (Xstart, 1). The position of the mark at a point in time when the five successive wins have occurred is (Xstart, 5) in a first column. By displaying the pieces of image data in the first display mode, the marks each indicating the winner are displayed in the moving display mode as shown in FIGS. 13A and 13B.

Each of this first display mode and the later-described second to fifth display modes is the moving display mode. In other words, in the moving display mode, the marks each indicating the winner are displayed in a moving manner. The marks each indicating the winner are displayed in the moving manner on the big road 302, thereby allowing a player to visually recognize the occurrence of the successive winning and a degree of the successive winning.

As shown in FIG. 12, the pieces of image data of the first display mode to fifth display mode are stored in the HDD 218 and the RAM 216 so as to correspond to the numbers of the successive wins, respectively. By reading out the pieces of image data in the display modes which each correspond to the numbers of the successive wins from the HDD 218 and the RAM 216, presentation images in the first display mode to fifth display mode can be displayed.

When the CPU 212 determines in the determination process at step S1019 that the five successive wins have not occurred, the CPU 212 determines whether or not six successive wins have occurred (step S1023).

Figure 14A:
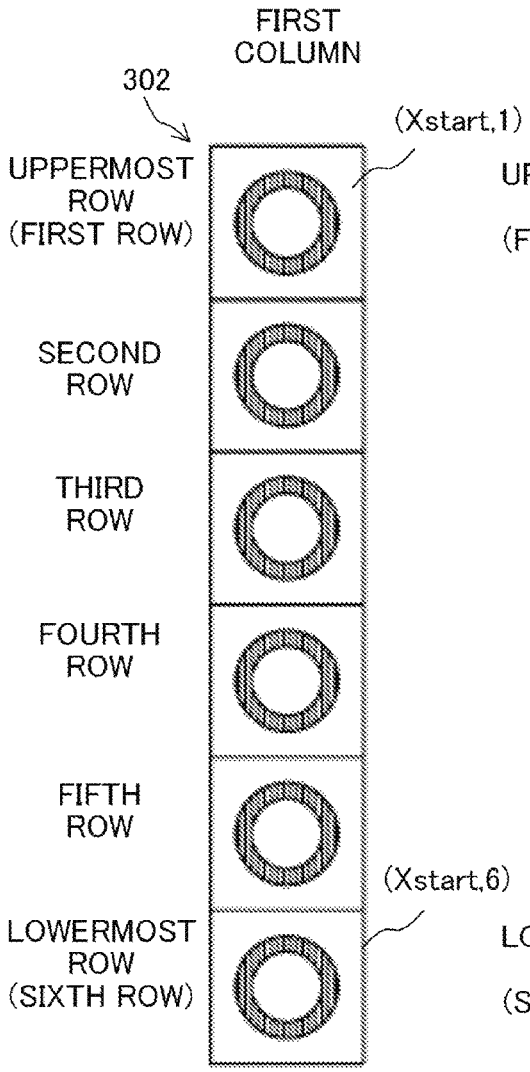
FIGS. 14A and 14B are diagrams illustrating an example of a specific image of successive winning presentation displayed on the game outcome notification display 300.
Figure 14B:
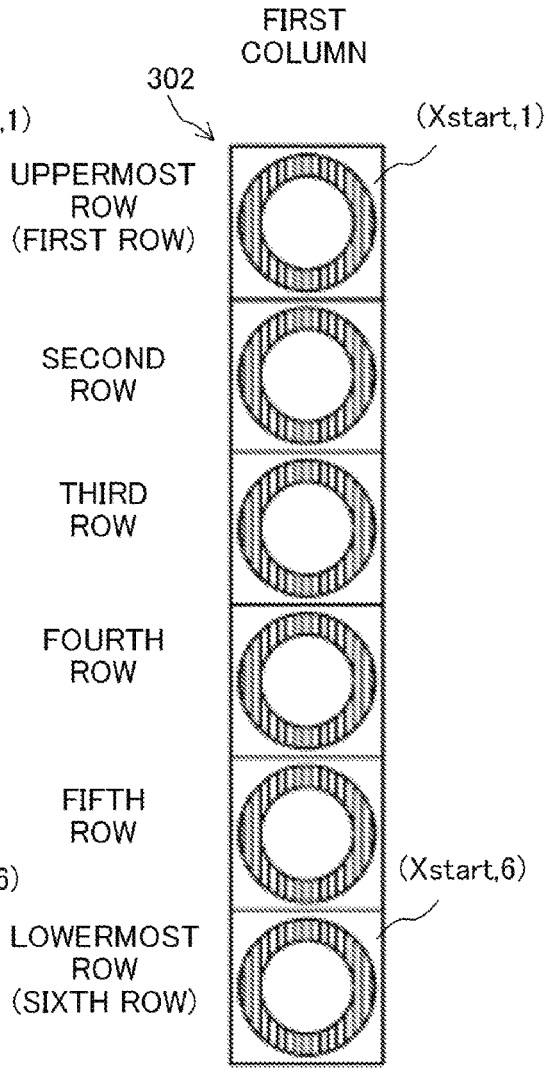

When the CPU 212 determines that the six successive wins have occurred, the CPU 212 displays pieces of image data in a second display mode in all of the mark display positions of the first to sixth successive wins (step S1025), finishing this subroutine. The position of the mark where the successive winning has started is (Xstart, 1). The position of the mark at a point in time when the six successive wins have occurred is (Xstart, 6) in the first column. By displaying the pieces of image data in the second display mode, the marks each indicating the winner are displayed in the moving display mode as shown in FIGS. 14A and 14B.

When the CPU 212 determines in the determination process at step S1023 that the six successive wins have not occurred, the CPU 212 determines whether or not seven successive wins have occurred (step S1027).

When the CPU 212 determines that the seven successive wins have occurred, the CPU 212 displays pieces of image data in a third display mode in all of the mark display positions of the first to seventh successive wins (step S1029), finishing this subroutine. The position of the mark where the successive winning has started is (Xstart, 1). The position of the mark at a point in time when the seven successive wins have occurred is (Xstart+1, 6) in a second column. By displaying the pieces of image data in the third display mode, the marks each indicating the winner are displayed in the moving display mode as shown in FIGS. 15A and 15B.

When the CPU 212 determines in the determination process at step S1027 that the seven successive wins have not occurred, the CPU 212 determines whether or not eight successive wins have occurred (step S1031).

When the CPU 212 determines that the eight successive wins have occurred, the CPU 212 displays pieces of image data in a fourth display mode in all of the mark display positions of the first to eighth successive wins (step S1033), finishing this subroutine. The position of the mark where the successive winning has started is (Xstart, 1). The position of the mark at a point in time when the eight successive wins have occurred is (Xstart+2, 6) in a third column. By displaying the pieces of image data in the fourth display mode, the marks each indicating the winner are displayed in the moving display mode as shown in FIGS. 16A and 16B.

When the CPU 212 determines in the determination process at step S1031 that the eight successive wins have not occurred, the CPU 212 determines whether or not nine successive wins have occurred (step S1035).

When the CPU 212 determines that the nine successive wins have occurred, the CPU 212 displays pieces of image data in a fifth display mode in all of the mark display positions of the first to ninth successive wins (step S1037), finishing this subroutine. The position of the mark where the successive winning has started is (Xstart, 1). The position of the mark at a point in time when the nine successive wins have occurred is (Xstart+3, 6) in a fourth column. By displaying the pieces of image data in the fifth display mode, the marks each indicating the winner are displayed in the moving display mode as shown in FIGS. 17A and 17B.

When the CPU 212 determines in the determination process at step S1031 that in the current game, the nine successive wins have not occurred, the CPU 212 finishes this subroutine.

<<<Display Mode Recovery Process>>>

FIG. 11 is a flowchart showing an example of a display mode recovery process. This process is called in the process at the above-described step S912 and is executed. The process shown in FIG. 11 is a process for returning the display mode in each of the moving display modes changed by the process shown in FIG. 10 to the original still display mode.

First, the CPU 212 of the first control unit 200 determines whether or not the successive winning of the five successive wins or more has been finished (step S1013).

When the CPU 212 determines that the successive winning of the five successive wins or more has not been finished, that is, a number of successive wins is four or less, the CPU 212 immediately finishes this subroutine. When the number of successive wins is four or less, the normal display mode is maintained and the display mode is not changed to any of the first to fifth display mode, and therefore, it is not needed to return the display mode to the original mode.

When the successive winning has not occurred or the number of successive wins is four or less, the mark(s) each indicating the winner is/are displayed in the still display mode in which each size thereof does not change temporally.

When the CPU 212 determines in the determination process at step S1013 that the successive winning of the five successive wins or more has been finished, the CPU 212 reads out image data in the normal display mode shown in FIG. 12 from the RAM 216 and the HDD 218 (step S1015).

As described above, in the normal display mode, the circular mark in the still display mode whose size does not change temporally is displayed. The mark of the virtual banker is displayed in red and the mark of the virtual player is displayed in blue. Accordingly, when the virtual banker has won, the red circular mark having the fixed size is displayed, whereas when the virtual player has won, the blue circular mark having the fixed size is displayed.

Next, the CPU 212 displays pieces of image data of marks in the normal display mode in display positions from where the successive winning has started to where the successive winning has finished (step S1017), finishing this subroutine.

The position of the mark upon the starting of the successive winning is (Xstart, 1). The position of the mark upon the finishing of the successive winning after the five successive wins have occurred is (Xstart, 5) (refer to FIGS. 13A and 13B). The position of the mark upon the finishing of the successive winning after the six successive wins have occurred is (Xstart, 6) (refer to FIGS. 14A and 14B). The position of the mark upon the finishing of the successive winning after the seven successive wins have occurred is (Xstart+1, 6) (refer to FIGS. 15A and 15B). The position of the mark upon the finishing of the successive winning after the eight successive wins have occurred is (Xstart+2, 6) (refer to FIGS. 16A and 16B). The position of the mark upon the finishing of the successive winning after the nine successive wins have occurred is (Xstart+3, 6) (refer to FIGS. 17A and 17B).

By using the position of the mark upon the starting of the successive winning and the positions of the marks upon the finishing of the successive winning, all of the marks each indicating the winner are redisplayed as the marks in the normal display mode.

As described above, when the successive winning of the five successive wins or more has occurred, the marks each indicating the winner are displayed in the moving display mode. As far as the successive winning continues, the marks each indicating the winner are displayed in the moving display mode. On the other hand, when the successive winning has finished, the processes at the above-described step S1013 to S1017 are executed and the marks are thereby displayed in the original still display mode. The marks are redisplayed as the marks in the still display mode, whereby it is made possible to show a player that the successive winning has finished.

<<<Specific Example of Successive Winning Presentation>>>

Each of FIG. 13A to FIG. 17B is a diagram illustrating specific images of successive winning presentation displayed on a game outcome notification display 300. Each of the diagrams shown in FIG. 13A to FIG. 17B illustrates one part of the big road 302. As shown in FIG. 7, on the big road 302, the mark M1 (red) or the M2 (blue) indicating any winner of the virtual banker or the virtual player is displayed in each of the cells. When the successive winning has occurred, the marks each indicating the winner are successively displayed in the cells of the big road 302. In other words, on the big road 302, a number of successively displayed marks shows a number of successive wins. In the examples shown in FIG. 13A to FIG. 17B, in order to facilitate clear illustration of the contents of presentation, the left-downward hatching indicating the virtual banker and the right-downward hatching indicating the virtual player are omitted.

<Case of Five Successive Wins>

FIGS. 13A and 13B are diagrams illustrating an example of an image of presentation displayed in a case of successive winning occurring at five times (five successive wins). FIGS. 13A and 13B are diagrams illustrating only one column in the big road 302. As shown in FIGS. 13A and 13B, each of the columns in the big road 302 is constituted of six cells. This is the presentation shown in the third column and the fourth column in FIG. 7.

When the five successive wins have occurred, the marks each indicating the winner are displayed such that sizes of the marks change periodically. A radius of each of the marks periodically and continuously changes, and the marks are displayed so as to continuously expand or shrink in a concentric manner. In FIG. 13A, the marks whose sizes are the smallest are shown, and in FIG. 13B, the marks whose sizes are the largest are shown. In the present embodiment, this presentation is referred to as "large and small size" presentation.

Here, the course of reaching the five successive wins will be briefly described.

As described above, on the big road 302, when the winner has changed, the mark indicating the winner is displayed in a cell in an uppermost row of a new column. This new column is a first column (Xstart). A position in a lateral direction of this first column is Xstart which is set at step S917. Accordingly, when the winner has changed, as the first win, the mark indicating the winner is displayed in (Xstart, 1) (not shown).

Next, when two successive wins have occurred, a mark is added and displayed in a cell (Xstart, 2) in a second row immediately below the uppermost row of the first column (not shown). In other words, two marks are successively displayed along the first column. At this time, the "large and small size" presentation does not yet start.

Further when three successive wins have occurred, a mark is added and displayed in a cell in a third row (Xstart, 3) immediately below the second row of the first column (not shown). In other words, three marks are successively displayed along the first column. Also at this time, the "large and small size" presentation does not yet start.

Subsequently, when four successive wins have occurred, a mark is added and displayed in a cell in a fourth row cell (Xstart, 4) immediately below the third row of the first column (not shown). In other words, four marks are successively displayed along the first column. Also at this time, the "large and small size" presentation does not yet start.

As described above, when the number of successive wins is four or less, the "large and small size" presentation is not conducted. When the marks each indicating the winner whose number is four or less are displayed along the first column, all of the marks each having a fixed size are displayed. In other words, when the number of successive wins is four or less, all of the marks each indicating the winner are displayed in a still display mode. In the present embodiment, the still display mode is referred to as a normal display mode.

Next, when the number of successive wins has reached five, that is, when the number of successive wins has switched from four to five, as shown in FIGS. 13A and 13B, a mark is added and displayed in a cell (Xstart, 5) in a fifth row immediately below the fourth row of the first column. Thus, five marks are successively displayed along the first column. Further, when the five successive wins have occurred, the "large and small size" presentation starts for the five successive marks.

This presentation upon the occurrence of the five successive wins is presentation in a first display mode (moving display mode) and is the "large and small size" presentation.

Displaying may be conducted such that all of the five marks concurrently start to change or the five marks start to change at respectively different timings. For example, the displaying may be conducted such that the five marks start to change sequentially in the order starting from the uppermost row to the fifth row of the first column.

When in a game after the occurrence of the five successive wins, losing has occurred, the successive winning has stopped, and the winner has changed, the "large and small size" presentation is finished and all of the five successive marks are displayed in the still display mode which is the normal display mode.

<Case of Six Successive Wins>

FIGS. 14A and 14B are diagrams illustrating an example of an image of presentation displayed in a case of successive winning occurring at six times (six successive wins). FIGS. 14A and 14B are diagrams illustrating only one column in the big road 302. This is the presentation shown in the fifth column and the sixth column in FIG. 7.

In this presentation, the "large and small size" presentation shown in FIGS. 13A and 13B is executed and circular marks are displayed such that a color of an outer peripheral part of each of the marks changes along its circumference. It is preferable that the color continuously changes. In FIG. 14A, the marks whose radiuses are the smallest and whose color is the palest are shown, and in FIG. 14B, the marks whose radiuses are the largest and whose color is the deepest are shown. A cycle of a size change and a cycle of a color change may be the same as each other or may be different from each other. The presentation in which the color of the outer peripheral part of each of the marks changes is referred to as "heatup" presentation.

As described above, when the five successive wins have occurred, the "large and small size" presentation is started for all of the five marks. Next, when the number of successive wins has reached six, that is, when the number of successive wins has switched from five to six, as shown in FIGS. 14A and 14B, a mark is added and displayed in a cell (Xstart, 6) in a lowermost row (sixth row) immediately below the fifth row of the first column. In other words, six marks are successively displayed along the first column. Further, when the six successive wins have occurred, both of the "large and small size" presentation and the "heatup" presentation start for the six successive marks.

This presentation upon the occurrence of the six successive wins is presentation in a second display mode (moving display mode) and is presentation in which the "large and small size" presentation and the "heatup" presentation are synthesized.

Displaying may be conducted such that all of the six marks concurrently start to change or the six marks start to change at respectively different timings. For example, the displaying may be conducted such that the six marks start to change sequentially in the order starting from the uppermost row to the lowermost row of the first column.

When in a game after the occurrence of the six successive wins, losing has occurred, the successive winning has stopped, and the winner has changed, the "large and small size" presentation and the "heatup" presentation are finished and all of the six successive marks are displayed in the still display mode which is the normal display mode.

<Case of Seven Successive Wins>

FIGS. 15A and 15B are diagrams illustrating an example of an image of presentation displayed in a case of successive winning occurring at seven times (seven successive wins). FIGS. 15A and 15B are diagrams illustrating only two columns in the big road 302. This is the presentation shown in the seventh column to eighth column and the ninth column to 10th column in FIG. 7.

In this presentation, the "large and small size" presentation and the "heatup" presentation shown in FIGS. 14A and 14B are executed and four small flames are displayed on an outer peripheral part of each of the circular marks. The four small flames are displayed in a moving manner so as to flicker. In FIG. 15A, the marks whose radiuses are the smallest and whose flames are the smallest are shown, and in FIG. 15B, the marks whose radiuses are the largest and whose flames are the largest are shown. A cycle of a size change and a cycle of a flame size change may be the same as each other or may be different from each other. The presentation in which the small flames are displayed on the outer peripheral part of each of the marks is referred to as "small flame" presentation.

As described above, when the six successive wins have occurred, the "large and small size" presentation and the "heatup" presentation are started for all of the six marks. Next, when the number of the successive wins has reached seven, that is, when the number of successive wins has switched from six to seven, a mark is added and displayed in a cell (Xstart+1, 6) in a lowermost row of a right-hand neighboring column (second column) of the first column. In other words, the marks are displayed in the six successive cells along the first column and the cell in the lowermost row of the right-hand neighboring second column. As described above, the seven marks are successively displayed so as to be of an L-shape. Further, when the seven successive wins have occurred, three kinds of presentation which are the "large and small size" presentation, the "heatup" presentation, and the "small flame" presentation start for the seven successive marks.

As described above, each of the columns in the big road 302 is constituted of six cells. Accordingly, in one column, up to six marks can be displayed. As shown in FIGS. 15A and 15B, the seventh mark is displayed in the cell (Xstart+1, 6) in the lowermost row of the right-hand neighboring second column. At this time, in cells from an uppermost row to a fifth row of the second column, no marks are displayed, and only five empty cells are displayed. As described above, the mark is displayed only in the lowermost row of the second column, thereby allowing conspicuous displaying of the occurrence of the successive winning to be made.

This presentation upon the occurrence of the seven successive wins is presentation in a third display mode (moving display mode) and is presentation in which the "large and small size" presentation, the "heatup" presentation, and the "small flame" presentation are synthesized.

Displaying may be conducted such that all of the seven marks concurrently start to change or the seven marks start to change at respectively different timings. For example, the displaying may be conducted such that the seven marks start to change sequentially in the order starting from the uppermost row of the first column to the lowermost row of the second column.

When in a game after the occurrence of the seven successive wins, losing has occurred, the successive winning has stopped, and the winner has changed, the "large and small size" presentation, the "heatup" presentation, and the "small flame" presentation are also finished and all of the seven successive marks are displayed in the still display mode which is the normal display mode.

<Case of Eight Successive Wins>

FIGS. 16A and 16B are diagrams illustrating an example of presentation displayed in a case of successive winning occurring at eight times (eight successive wins). FIGS. 16A and 16B are diagrams illustrating only three columns in the big road 302. This is the presentation shown in the 11th column to 13th column and the 14th column to 16th column in FIG. 7.

In this presentation, the "large and small size" presentation and the "heatup" presentation shown in FIGS. 14A and 14B are executed and four large flames are displayed on an outer peripheral part of each of the circular marks. The four large flames are displayed in a moving manner so as to wholly flicker. In FIG. 16A, the marks whose radiuses are the smallest and whose flames are the smallest are shown, and in FIG. 16B, the marks whose radiuses are the largest and whose flames are the largest are shown. A cycle of a radius size change and a cycle of a flame size change may be the same as each other or may be different from each other. The presentation in which the large flames are displayed on the outer peripheral part of each of the marks is referred to as "large flame" presentation.

As described above, when the seven successive wins have occurred, the "large and small size" presentation, the "heatup" presentation, and the "small flame" presentation are started for all of the seven marks. Next, when the number of successive wins has reached eight, that is, when the number of successive wins has switched from seven to eight, a mark is added and displayed in a cell (Xstart+2, 6) in a lowermost row of a right-hand neighboring column (third column) of the second column. In other words, the marks are displayed in the six successive cells along the first column, the cell in the lowermost row of the second column, and the cell in the lowermost row of the third column. As described above, the eight marks are successively displayed so as to be of an L-shape. Further, when the eight successive wins have occurred, three kinds of presentation which are the "large and small size" presentation, the "heatup" presentation, and the "large flame" presentation start for the eight successive marks.

As shown in FIGS. 16A and 16B, the eighth mark is displayed in the cell in the lowermost row (the sixth cell from the upper) of the third column. At this time, in 10 cells from the uppermost rows (first rows) to the fifth rows of the second column and the third column, no mark are displayed, and only 10 empty cells are displayed. As described above, the marks are displayed only in the lowermost rows of the second column and the third column and the displaying is thereby conducted so as to increase the empty cells, thus allowing conspicuous displaying of the occurrence of the successive winning to be made.

This presentation upon the occurrence of the eight successive wins is presentation in a fourth display mode (moving display mode) and is presentation in which the "large and small size" presentation, the "heatup" presentation, and the "large flame" presentation are synthesized.

Displaying may be conducted such that all of the eight marks concurrently start to change or the eight marks start to change at respectively different timings. For example, the displaying may be conducted such that the eight marks start to change sequentially in the order starting from the uppermost row of the first column to the lowermost row of the third column.

When in a game after the occurrence of the eight successive wins, losing has occurred, the successive winning has stopped, and the winner has changed, the "large and small size" presentation, the "heatup" presentation, and the "large flame" presentation are also finished and all of the eight successive marks are displayed in the still display mode which is the normal display mode.

<Case of Nine Successive Wins>

FIGS. 17A and 17B are diagrams illustrating an example of presentation displayed in a case of successive winning occurring at nine times (nine successive wins). FIGS. 17A and 17B are diagrams illustrating only four columns in the big road 302. This is the presentation shown in the 17th column to 20th column, the 21th column to 24th column, the 25th column to 28th column, and the 29th column to 32th column.

In this presentation, the "large and small size" presentation, the "heatup" presentation, and the "large flame" presentation shown in FIGS. 16A and 16B are executed, and a plurality of streaks of lightning are displayed so as to be superimposed thereon. The streaks of lightning are displayed in a moving manner such that a position, a size, and a direction of each thereof change with time. In FIG. 17A, the marks whose radiuses are the smallest and on which the streaks of lightning are generated are shown, and in FIG. 17B, the marks whose radiuses are the largest and on which the streaks of lightning are generated are shown. A cycle of a size change and a cycle of each change in a size of each of the streaks of lightning, the position, and the direction may be the same as each other or may be different from each other. The presentation in which the plurality of streaks of lightning are displayed is referred to as "streaks of lightning" presentation.

As described above, when the eight successive wins have occurred, the "large and small size" presentation, the "heatup" presentation, and the "large flame" presentation are started for all of the eight marks. Next, when the number of successive wins has reached nine, that is, when the number of successive wins has switched from eight to nine, a mark is added and displayed in a cell (Xstart+3, 6) in a lowermost row of a right-hand neighboring column (fourth column) of the third column. In other words, the marks are displayed in the six successive cells along the first column, the cell in the lowermost row of the second column, the cell in the lowermost row of the third column, and the cell in the lowermost row of the fourth column. As described above, the nine marks are successively displayed so as to be of an L-shape. Further, when the nine successive wins have occurred, four kinds of presentation which are the "large and small size" presentation, the "heatup" presentation, the "large flame" presentation, and the "streaks of lightning" presentation start for the nine successive marks.

As shown in FIGS. 17A and 17B, the ninth mark is displayed in the cell in the lowermost row (the sixth cell from the upper) of the fourth column. At this time, in 15 cells of the uppermost rows (the first rows) to the fifth rows of the second column, the third column, and the fourth column, no mark are displayed, and only 15 empty cells are displayed. As described above, the marks are displayed only in the lowermost rows of the second column, the third column, and the fourth column and the displaying is thereby conducted so as to increase the empty cells, thus allowing conspicuous displaying of the occurrence of the successive winning to be made.

This presentation upon the occurrence of the nine successive wins is presentation in a fifth display mode (moving display mode) and in which the "large and small size" presentation, the "heatup" presentation, the "large flame" presentation, and the "streaks of lightning" presentation are synthesized.

Displaying may be conducted such that all of the nine marks concurrently start to change or the nine marks start to change at respectively different timings. For example, the displaying may be conducted such that the nine marks start to change sequentially in the order starting from the uppermost row of the first column to the lowermost row of the fourth column.

When in a game after the occurrence of the nine successive wins, losing has occurred, the successive winning has stopped, and the winner has changed, the "large and small size" presentation, the "heatup" presentation, the "large flame" presentation, and the "streaks of lightning" presentation are also finished and all of the nine successive marks are displayed in the still display mode which is the normal display mode.

<Case of Further Successive Winning>

In a case where further successive winning has occurred, an image in which a character or the like appears on the whole or a part of the big road 302 may be displayed. For example, a presentation image in which a dragon appears and flies around on the big road 302 can be displayed. Further, a presentation image in which flames rise up from a lower part of the big road 302 and burn the big road 302 may be displayed. As described above, in the case where the number of the successive winning has increased, overall presentation which does not depend on a size and a shape of each of the cells of which the matrix of the big road 302 is constituted is conducted, thereby allowing a player to easily visually recognize that the number of successive wins has increased and a special state is happening.

What is claimed is:

1. A game table apparatus comprising:

a gaming table with a plurality of predefined gaming positions at which players can be stationed;

a controller configured to manage winning or losing of a game that is played at the gaming table;

a memory configured to store first display information and second display information whose display mode is different from a display mode of the first display information, the first display information being information displayed in a still display mode and the second display information being information displayed in a moving display mode; and a game outcome notification display associated with the gaming table and configured to display the first and second display information to players at the predefined gaming positions in a visually recognizable manner, the controller being programmed to execute processes described below to indicate a number of successive winning through the game outcome notification display:

a first process in which when a game is started and winning or losing is determined as a win-or-loss outcome of the game, the first display information, which corresponds to the outcome of the game at the gaming table, is read out from the memory and is subsequently displayed on the game outcome notification display;

a second process in which, while the same win-or-loss outcome as determined in the first process occurs as the outcome of a subsequent plurality of successive games, pieces of the first display information corresponding to the outcomes of the subsequent plurality of successive games are sequentially displayed on the game outcome notification display adjacent to each other such that the pieces of the first display information extend in a first direction; and a third process in which, when the same win-or-loss outcome results for a predetermined threshold-number of successive games, the second display information is read out from the memory and the first display information corresponding to the outcomes of the subsequent plurality of successive games is changed to the second display information as long as the number of successive games for which the same win-or-loss outcome occurs has reached or exceeded the predetermined threshold-number, with pieces of the second display information being arranged adjacent to each other and extending in the first direction;

further comprising a card shoe for holding cards to conduct a game on the game table and for allowing the cards to be taken out, wherein the card shoe has a detection device configured to detect and output pieces of identification information of the cards taken out from the card shoe, and the controller is further programmed to execute:

a fourth process in which the pieces of the identification information of the cards outputted from the detection device are accumulated in the memory; and a fifth process in which based on the pieces of the identification information of the cards accumulated in the memory, the winning or losing in the game is determined.

2. The game table apparatus according to claim 1, wherein each of the pieces of the first display information is displayed each time a game is finished.

3. The game table apparatus according to claim 1, wherein the controller is further programmed to execute a fourth process in which when the win-or-loss outcome of a further successive game becomes the opposite of the win-or-loss outcome determined in the first process, the second display information is returned to the first display information, and the first display information is displayed on the display.

4. The game table apparatus according to claim 1, further comprising an input device for allowing a user to perform an input operation, wherein the controller is further programmed such that when identification information of a card outputted from the detection device is invalid, the input device allows valid identification information of the card taken out from the card shoe to be inputted, and winning or losing in a game is determined in accordance with the valid identification information.

5. The game table apparatus according to claim 1, wherein the second display information has a plurality of pieces of presentation-related information which are defined each in accordance with a number of games and whose display modes are different from one another, and the second process is a process in which when the subsequent plurality of successive games are conducted and the same win-or-loss outcome as determined in the first process continues to occur, presentation-related information corresponding to the number of games for which the same win-or-loss outcome occurs is read out from the memory and is displayed on the display.

6. The game table apparatus according to claim 1, wherein the display is provided with a game outcome display region being operable to display a mark indicating an outcome of a game played at the gaming table, the game outcome display region includes a plurality of individual game outcome display regions, each of the plurality of individual game outcome display regions is operable to display one mark indicating an outcome of one game, the first process is a process in which when an outcome of one game is a predetermined outcome, a predetermined mark is displayed in one of the plurality of individual game outcome display regions such that a display mode of said individual game outcome display region is a first display mode, and the second process is a process in which when each of all of outcomes of successive games whose number is N is the predetermined outcome, the predetermined mark is displayed in each of the individual game outcome display regions whose number is N among the plurality of individual game outcome display regions such that a display mode of each of the individual game outcome display regions is a second display mode that is different from the first display mode.

7. The game table apparatus according to claim 6, wherein the second process includes changing over time a size of the predetermined mark displayed in each of the individual game outcome display regions whose number is N when each of all of the outcomes of the successive games whose number is N is the predetermined outcome.

8. The game table apparatus according to claim 6, wherein the second process includes changing over time a color of the predetermined mark displayed in each of the individual game outcome display regions whose number is N when each of all of the outcomes of the successive games whose number is N is the predetermined outcome.

9. The game table apparatus according to claim 6, wherein the second process includes displaying an additional image on the predetermined mark displayed in each of said individual game outcome display regions and changing over time a display mode of the additional image when each of all of the outcomes of the successive games whose number is N is the predetermined outcome.

10. The game table apparatus according to claim 6, wherein the second process includes changing over time either one of the size and the color of the predetermined mark displayed in each of the individual game outcome display regions whose number is N when each of all of the outcomes of the successive games whose number is N is the predetermined outcome, and the controller is programmed to execute a fourth process in which when each of all of the outcomes of successive games whose number is (N+1) is the predetermined outcome, the predetermined mark is displayed in each of the individual game outcome display regions whose number is (N+1) among the plurality of individual game outcome display regions, and both of the size and the color of the displayed predetermined mark are changed over time.

11. The game table apparatus according to claim 10, wherein the controller is further programmed to execute a fifth process in which when each of all of the outcomes of successive games whose number is (N+2) is the predetermined outcome, the predetermined mark is displayed in each of the individual game outcome display regions whose number is (N+2) among the plurality of individual game outcome display regions; both of the size and the color of the displayed predetermined mark are changed over time; in each of the individual game outcome display regions, an additional image is displayed on the predetermined mark displayed in each of said individual game outcome display regions; and a display mode of said additional image is changed over time.

12. A game table apparatus comprising:

a gaming table with a plurality of predefined gaming positions at which players can be stationed;

a controller configured to manage winning or losing of a game that is played at the gaming table;

a memory configured to store first display information and second display information whose display mode is different from a display mode of the first display information, the first display information being information displayed in a still display mode and the second display information being information displayed in a moving display mode; and a game outcome notification display associated with the gaming table and configured to display the first and second display information to players at the predefined gaming positions in a visually recognizable manner, the controller being programmed to execute processes described below to indicate a number of successive winning through the game outcome notification display:

a first process in which when a game is started and winning or losing is determined as a win-or-loss outcome of the game, the first display information, which corresponds to the outcome of the game at the gaming table, is read out from the memory and is subsequently displayed on the game outcome notification display;

a second process in which, while the same win-or-loss outcome as determined in the first process occurs as the outcome of a subsequent plurality of successive games, pieces of the first display information corresponding to the outcomes of the subsequent plurality of successive games are sequentially displayed on the game outcome notification display adjacent to each other such that the pieces of the first display information extend in a first direction; and a third process in which, when the same win-or-loss outcome results for a predetermined threshold-number of successive games, the second display information is read out from the memory and the first display information corresponding to the outcomes of the subsequent plurality of successive games is changed to the second display information as long as the number of successive games for which the same win-or-loss outcome occurs has reached or exceeded the predetermined threshold-number, with pieces of the second display information being arranged adjacent to each other and extending in the first direction;

wherein the display is provided with a game outcome display region being operable to display a mark indicating an outcome of a game played at the gaming table, the game outcome display region includes a plurality of individual game outcome display regions, each of the plurality of individual game outcome display regions is operable to display one mark indicating an outcome of one game, the first process is a process in which when an outcome of one game is a predetermined outcome, a predetermined mark is displayed in one of the plurality of individual game outcome display regions such that a display mode of said individual game outcome display region is a first display mode, and the second process is a process in which when each of all of outcomes of successive games whose number is N is the predetermined outcome, the predetermined mark is displayed in each of the individual game outcome display regions whose number is N among the plurality of individual game outcome display regions such that a display mode of each of the individual game outcome display regions is a second display mode that is different from the first display mode, and further wherein the controller is further programed to execute a fourth process in which when each of all of the outcomes of successive games whose number is M is the predetermined outcome, the predetermined mark is displayed in each of the individual game outcome display regions whose number is M, the individual game outcome display regions being arranged in one direction, and a fifth process in which when each of all of the outcomes of successive games whose number is (M+1) is the predetermined outcome, the predetermined mark is displayed in each of the individual game outcome display regions whose number is M, and the predetermined mark is displayed in an individual game outcome display region among individual game outcome display regions being arranged in a direction perpendicular to the one direction, the individual game outcome display region neighboring to one of the individual game outcome display regions whose number is M.

13. A game table apparatus comprising:

a gaming table with a plurality of predefined gaming positions at which players can be stationed;

a card shoe configured to hold cards to conduct a game on the game table and for allowing the cards to be taken out;

a controller configured to manage winning or losing of a game that is played at the gaming table;

a memory configured to store first display information and second display information whose display mode is different from a display mode of the first display information; and a display associated with the gaming table and configured to display the first and second display information to players at the predefined gaming positions in a visually recognizable manner; wherein the card shoe has a detection device configured to read out and output pieces of identification information of the cards taken out, an outcome of a game is allowed to be determined based on the pieces of identification information of the cards, the first display information is information selected in accordance with winning or losing in the game, the second display information is information selected in accordance with bias with respect to the winning or losing in the game, and the controller is programmed to execute processes described below:

a first process in which when the cards are taken out from the card shoe, the pieces of identification information of the cards outputted from the detection device are accumulated in the memory; and a second process in which determined is whether or not based on the pieces of identification information of the cards accumulated in the memory, determining winning or losing in a game is enabled; wherein when determining the winning or losing in the game is not enabled, the first process and the second process are repeated until determining the winning or losing in the game comes to be enabled; and wherein when determining the winning or losing in the game is enabled, the first display information corresponding to the winning or losing in the game is read out from the memory;

a third process in which the first display information is displayed on the display;

a fourth process in which by repeatedly executing the first, second, and third processes, whether or not winning has successively occurred is determined by conducting a plurality of games;

wherein when the winning has successively occurred, a number of games in which the winning has successively occurred is counted and, based on the number of games counted, any of pieces of the second display information is selected and read out from the memory and instead of the first display information, the read-out piece of the second display information is displayed on the display.

14. The game table apparatus according to claim 13, wherein the second display information has a plurality of pieces of display information, each of which is defined in accordance of each number of a plurality of games, display modes of the plurality of pieces of display information are different from one another, and any of the plurality of pieces of display information which corresponds to the number of games that have been counted is selected and read out from the memory.

15. The game table apparatus according to claim 13, wherein the controller is programmed such that the game is a game in which a virtual banker and a virtual player have a match, and when winning of one of the virtual banker and the virtual player has successively occurred over a predetermined number of a plurality of games, instead of the first display information, the second display information is displayed on the display.

16. The game table apparatus according to claim 1, wherein the third process includes a process in which a direction in which the pieces of the second display information is arranged is changed to a direction different from the first direction.

* * * * *